US005451478A

United States Patent [19]

Boggs et al.

[11] Patent Number: 5,451,478

[45] Date of Patent: Sep. 19, 1995

[54] SLIDE BLANK, AND PROCESS FOR PRODUCING A SLIDE THEREFROM

[75] Inventors: Roger A. Boggs, Wayland; Yves G. Conturie, Needham; Edward P. Lindholm, Brookline; Warren D. Slafer, Arlington; Stephen J. Telfer, Arlington; Michael J. Zuraw, Arlington, all of Mass.

[73] Assignee: Polaroid Corporation, Cambridge, Mass.

[21] Appl. No.: 226,657

[22] Filed: Apr. 12, 1994

[51] Int. Cl.[6] ..... G03C 1/73; G03C 1/76

[52] U.S. Cl. ..... 430/11; 430/17; 430/332; 430/333; 430/338; 430/496; 40/159.2

[58] Field of Search ..... 430/338, 332, 333, 496, 430/11, 17; 40/158.1, 159.2

[56] References Cited

U.S. PATENT DOCUMENTS

| | | | |
|---|---|---|---|
| 2,515,939 | 7/1950 | Stookey | 49/92 |
| 2,592,262 | 4/1952 | Fox | 40/159.2 |
| 2,716,300 | 8/1955 | Bopp | 41/26 |
| 3,195,434 | 7/1965 | Dietz | 95/66 |
| 3,591,943 | 7/1971 | Green | 40/158 |
| 3,650,057 | 3/1972 | Johnson et al. | 40/158 R |
| 3,727,334 | 4/1973 | Sakamoto | 40/104 |
| 3,921,318 | 11/1975 | Calavetta | 40/2.2 |
| 4,482,608 | 11/1984 | Isbrandt | 428/421 |
| 4,566,770 | 1/1986 | Czumak et al. | 354/276 |
| 4,602,263 | 7/1986 | Borrer et al. | 346/201 |
| 4,619,876 | 10/1986 | Woodward | 430/11 |
| 4,637,974 | 1/1987 | Kubit | 430/126 |
| 4,663,518 | 5/1987 | Borrer et al. | 235/487 |
| 4,680,460 | 7/1987 | Drexler | 235/488 |
| 4,720,449 | 1/1988 | Borrer et al. | 430/338 |
| 4,720,450 | 1/1988 | Ellis | 430/339 |
| 4,742,631 | 5/1988 | Zimble | 40/158 B |
| 4,745,046 | 5/1988 | Borrer et al. | 430/332 |
| 4,818,742 | 4/1989 | Ellis | 503/201 |
| 4,826,976 | 5/1989 | Borrer et al. | 544/58.4 |
| 4,839,335 | 6/1989 | Ellis | 503/224 |
| 4,886,732 | 12/1989 | Mauchen et al. | 430/210 |
| 4,894,358 | 1/1990 | Filosa et al. | 503/201 |
| 4,942,684 | 7/1990 | Oehmichen | 40/152 |
| 4,960,901 | 10/1990 | Borrer et al. | 548/207 |
| 4,988,556 | 1/1991 | Nilsen et al. | 428/195 |
| 5,170,261 | 12/1992 | Cargill et al. | 358/298 |
| 5,200,297 | 4/1993 | Kelly | 430/253 |
| 5,234,886 | 8/1993 | Sarraf et al. | 503/227 |
| 5,236,884 | 8/1993 | Boggs et al. | 503/201 |
| 5,243,052 | 9/1993 | Taylor et al. | 546/154 |
| 5,278,031 | 1/1994 | Boggs et al. | 430/348 |
| 5,286,612 | 2/1994 | Telfer | 430/335 |

FOREIGN PATENT DOCUMENTS

| | | |
|---|---|---|
| 157568 | 10/1985 | European Pat. Off. . |
| WO88/04237 | 6/1988 | WIPO . |
| WO92/19454 | 11/1992 | WIPO . |

OTHER PUBLICATIONS

Liggero et al., The Polaroid 35 mm Instant Slide System, J. Imaging Technology, 10, 1–9, (1984).

Sturge, J. et al., Imaging Processes and Materials (Neblette's Eighth Edition) (1989), pp. 194–195 and 210–211.

*Primary Examiner*—Charles L. Bowers, Jr.
*Assistant Examiner*—John A. McPherson
*Attorney, Agent, or Firm*—David J. Cole

[57] ABSTRACT

A slide blank comprises a support at least part of which is essentially transparent; an imageable layer superposed on one face of the support, the imageable layer not being substantially photosensitive but comprising a color-forming composition, which, upon imagewise exposure to actinic radiation, forms a colored material, thereby forming in the imageable layer an image which can be viewed in transmission; and a protective layer superposed on the imageable layer on the opposed side thereof from the support, at least part of the protective layer being essentially transparent; the support, imageable layer and protective layer being secured together to form a slide blank having a thickness of at least about 0.8 mm, and the thickness of the protective layer being such that no part of the imageable layer containing the color-forming composition is more than about 0.2 mm from one external surface of the slide blank. This slide blank can be imaged to produce a ready-mounted slide.

41 Claims, 4 Drawing Sheets

SLIDE BLANK, AND PROCESS FOR PRODUCING A SLIDE THEREFROM

REFERENCE TO RELATED APPLICATION

Attention is directed to copending application Ser. No. 08/226,452 filed simultaneously herewith and assigned to the same assignee as this application; this copending application describes and claims a slide blank generally similar to that of the present invention but having, as an essential feature, a mask layer with a substantially transparent central portion and a non-transparent peripheral portion surrounding this central portion.

BACKGROUND OF THE INVENTION

This invention relates to a slide blank, a slide and a process for producing a slide. The term "slide blank" is used herein to refer to a unit which resembles a slide lacking an image, and which upon imaging will form a ready-mounted slide suitable for projection.

Hitherto, slides have typically been produced by exposing a roll of silver halide film using either a camera or a film recorder (for example that sold as the CI-5000 film recorder by Polaroid Corporation), which receives a digital image from a computer or similar image processing equipment and exposes the film. In either case, only a latent image is produced upon the film, which requires development and fixing to produce visible images. After development and fixing, the various images on the film are separated from one another and each imaged film portion is mounted by placing it in a slide mount. Conventional slide mounts typically consist of two rectangular sheets of plastic, card or other relatively rigid material, each sheet having a rectangular central cut-out or "window." The developed and fixed film portion is sandwiched between the two sheets of the slide mount so that its image can be viewed in transmission through the two windows, which are aligned with each other and with the image, and the two sheets of the slide mount and the film portion are all secured together.

Such conventional slides suffer from several discrete problems, most of which are felt acutely by users making presentation graphics slides. As with any silver halide roll film, each roll of slide film can produce a number (typically 12, 20, 24 or 36) of images, and one must either expose the whole roll before processing or waste the unexposed portion of the roll. In addition, the development and fixing of the latent images require substantial investment in processing equipment, or the delays inherent in the use of independent photographic processors. Even those who regularly produce presentation graphics slides, and have "in-house" access to film recorders, typically rely upon such processors to develop and fix the film, thus incurring delays of a few hours to a day between the exposure of the film and the availability of the finished slide.

Polaroid Corporation sells, under the Registered Trade Mark "POLACHROME," slide films comprising diffusion transfer film units ("instant films"); these slide films, and apparatus for their processing, are described, for example, in Liggero et al., The Polaroid 35 mm Instant Slide System, J. Imaging Technology, 10, 1-9 (1984), and Sturge, J., Walworth, V., and Shepp, A. (eds.), Imaging Processes and Materials (Neblette's Eighth Edition), Van Nostrand Reinhold, New York (1989), pages 194–95 and 210–11. These slide films comprise a plurality of photosensitive elements, which are exposed in the same manner as conventional silver halide films. After as many of the photosensitive elements as desired have been exposed, the whole film is run through a specially designed apparatus, which causes development and formation of images on image-receiving elements. The image-receiving elements are then peeled from the photosensitive elements, separated from one another and mounted in the same manner as conventional slide films. Although this type of slide film does eliminate the delays inherent in the processing of conventional slide films, it still requires that all the photosensitive elements in a film be exposed before any are developed, or the remainder wasted, and the mounted slides produced are similar to those produced from conventional slide films, and thus suffer from the disadvantages of conventional mounted slides discussed below.

Conventional slides also suffer from problems associated with the physical form of the finished slide. It is not easy to secure the film portion securely between the two parts of the slide mount in a manner that will prevent movement of the film portion during heavy use of the slide, such as may occur when the slide is used for repeated presentations or in an automated slide changer at an exhibition. Even slight movement of the film portion relative to the slide mount causes an objectionable strip of white to appear along one edge of the projected image. Furthermore, in a conventional slide the fragile film portion is exposed through the windows in the slide mount and is easily damaged or marked, for example by the fingerprints of a user during handling. Furthermore, the heating which the exposed, relatively flexible film portion undergoes during projection tends to cause the film portion to buckle out of the focal plane of the projector lens, and such buckling may adversely affect the quality of the projected image. To prevent or reduce such marking or buckling, so-called "glass mounts" are sometimes used. These glass mounts resemble conventional slide mounts but sandwich the film portion between two thin, transparent sheets of glass, which extend across the windows in the slide mount. Although glass mounts do reduce the risk of accidental marking or buckling of the film portion, the glass sheets are themselves fragile and are readily broken. In addition, dirt or other particles can become trapped between the glass sheets and the film portion, causing unwanted artifacts on the image seen when the slide is projected.

Whether or not glass mounts are used, the difference in thickness between the window and the remaining portions of the mounted slide leaves a "step" extending around the image. This step tends to trap dirt, fibers and other detritus, which are difficult to remove without damaging the film portion, and which may produce undesirable artifacts when the slide is projected.

Conventional slides place restrictions on the shape of the images that can be produced. Slide mounts are normally only produced with windows having a fixed aspect ratio, and the image must either conform to this aspect ratio or part of the window must be covered by an opaque area, thus reducing the size of the image seen upon projection. Obviously, if desired, images can be produced in either portrait or landscape orientation, but if a presentation includes slides in both orientations, the user must manually place the slides in the projector in their correct orientation, and most frequent users of slides are familiar with the embarrassment that results when a slide is inadvertently shown in the wrong orientation.

Perhaps the worst disadvantage of conventional slides, however, is the lack of any facility for keeping one or more identifying indicia (for example, time and date of production, number of the slide in a series, or the name of the data file used to produce the image) associated with the image and visible on the mounted slide. Cameras are known having backs that can place the time and date, or other user-defined indicium, on a small area of a negative as it is exposed, so that a reflection print produced from the negative will display the indicium, usually in an inconspicuous corner of the print. Provision of such a visible indicium is not practical in the case of slides, since the user needs to be able to read the indicium on the slide before he places it in the projector, and an indicium large enough to be legible in these circumstances would occupy so large a proportion of the slide as to be highly objectionable when projected. Although it is possible to provide appropriate indicia on mounted slides by writing, printing or securing adhesive labels on the surface of the slide mount, there remains the difficulty of matching up the indicia with each slide after the slide has been returned from processing. This problem is especially difficult for frequent users of presentation graphic slides, who may have several sets of slides being processed at any one time, and may have several slides of the same general type (for example, pie charts), or several revisions of the same slide, which are easily confused and thus subject to mislabeling. The risk of mislabeling is increased by the ease with which the order of a series of slides may be disturbed by the many handling operations needed in conventional processing.

One commercial form of slide mount attempts to overcome this problem by providing a small cut-out on one half of the slide mount adjacent its window, this cut-out serving to expose a non-image area of the film so that any indicia on this non-image area can be read in reflection against a background provided by the other half of the slide mount. When such a slide mount is used with a conventional silver halide film, the non-image area exposed is that containing one set of the sprocket holes of the film, and conventional cameras and film recorders will not print in this area. Furthermore, the area available is extremely limited, since the edge of the film must be secured in the slide mount, and the area available is interrupted by the sprocket holes themselves. In practice, the only indicium which can be visible in the cut-out is the frame number of the image on the film, and while the use of such a slide mount serves to prevent placing a series of slides in the wrong order, the user is still left with the problem of associating each frame number with the appropriate caption or other indicium. Moreover, the visible frame numbers do not assist the user in identifying the roll of film from which the slide is derived.

Use of slides in presentations would be greatly simplified if a system could be developed by which a caption or other identifying indicium could be associated with an image as it is created (normally by means of computer software) such that a slide produced from the image would display the caption in a legible size on the slide mount outside the window.

In recent years, various "direct-imaging media" have been developed which allow direct formation of a visible positive image on the medium without requiring development or fixing steps using liquid reagents. Such media include those described in U.S. Pat. Nos. 4,602,263; 4,720,449; 4,720,450; 4,745,046; 4,818,742; 4,826,976; 4,839,335; 4,894,358 and 4,960,901 (in which heating of the medium causes a chemical and color change in a thermally sensitive material) and the media described in U.S. Pat. Nos. 5,278,031; 5,286,612; 5,334,489 and 5,395,736, and application Ser. No. 08/141/852 (filed Oct. 22, 1993) (which media when exposed to radiation generate acid which changes the color of an indicator dye). These two types of medium may hereinafter be called "direct-imaging single sheet media."

U.S. Pat. No. 5,234,886, issued Aug. 10, 1993 on application Ser. No. 07/722,810 filed Jun. 28, 1991, describes a slide blank intended for imaging by dye diffusion thermal transfer. This slide blank comprises a rectangular piece of dye receiving material secured in the aperture of a conventional plastic slide mount. Although this slide blank can be imaged and displayed immediately after imaging without any post-imaging mounting steps, it is not very efficient for mass production, since it requires insertion and securing of individual pieces of dye receiving material within the apertures in the slide mounts, and does nothing to solve the problem of associating identifying indicia with each slide. Furthermore, slides produced from such slide blanks may suffer from certain problems often associated with dye diffusion thermal transfer images, such as the tendency for the image dye (which is present on one external surface of the slide) to release dye on to, and thus contaminate, any objects, for example slide pockets, which come into contact with the image. Such dye release is also likely to degrade the image on the slide.

As mentioned above, direct-imaging single sheet media have the advantage that no development or fixing steps requiring liquid reagents are required after imaging. Accordingly, it is not necessary for the color-forming layers of such media to be exposed on a external surface of the medium; the color-forming layers, which tend to be rather fragile, can be protected by a protective layer (also called an "overcoat") and imaged by radiation passed through this protective layer. Accordingly, it might be thought that a slide blank could be produced simply by sandwiching a direct-imaging single sheet medium between two similar sheets of plastic material to form a slide blank which would, after imaging, produce a slide closely resembling a conventional slide. Applicants have attempted to produce slides using this type of slide blank (hereinafter called a "symmetric blank"), but have discovered that such a slide blank suffers from certain mechanical problems. In such a symmetric blank, the direct-imaging medium is normally the weakest layer of the blank, and is thus the point at which delamination of the various layers of the blank is likely to begin. Placing the weak imaging medium between two substantially rigid plastic sheets renders the symmetric blank and a slide produced therefrom susceptible to accidental or deliberate delamination. Furthermore, as discussed below, the most cost-effective process for producing a slide blank involves severing individual slide blanks from large sheets or webs, preferably by die cutting, and a weak imaging medium sandwiched between two substantially rigid plastic sheets is likely to be damaged by such die cutting.

A symmetric slide blank also suffers from optical problems during imaging. During such imaging, a beam of radiation must be focussed through one of the plastic sheets and brought to a focus in, or very closely adjacent, a color-forming layer which is typically only a few microns thick. Thus, a small change in the position of the focus may prevent imaging of the color-forming layer, or at least severely reduce the image density. Unfortunately, all commercial plastic sheets suffer from substantial variations in thickness ("gauge variations"), such variations typically being ±10%. If a symmetric blank is produced by sandwiching an imaging medium between two 20 mil sheets, a ±2 mil variation in the thickness of the sheet through which exposure is effected will produce a change in the position of the focus likely to be large enough to prevent imaging of the color-forming layer. Although techniques (such as effecting a focus series on each slide) do exist for correcting the position of the focus, the use of such correction techniques adds complexity to the apparatus used to image the slide, slows down the imaging process and results in undesirable markings on the printed slide. Moreover, in a symmetric blank, birefringence is likely to be a problem. Biaxial birefringence distorts the shape of the spot produced by a focussed beam, and in extruded sheets of plastic, such birefringence varies in orientation from point to point particularly in widely separated parts of a long web, between different webs, and between slides fed into a printer in different orientations. If focus correction techniques are attempted in a material of varying birefringence, such techniques will not work at every point on every slide. Accordingly, a symmetric blank is limited to materials having low birefringence.

Finally, applicants have discovered that upon prolonged projection of slides produced from symmetric blanks, the colors of the slide tend to change, and the contrast between regions of minimum and maximum density ($D_{min}$ and $D_{max}$ regions respectively) tends to diminish. It is believed, although the present invention is in no way limited by this belief, that the reason for these undesirable changes in such slides upon prolonged projection is the large quantities of heat generated within the slide caused by absorption of radiation from the projector, and consequent unwanted development of color in non-imaged regions of the color-forming layers. For example, in a multicolor slide of this type there will normally be three color-forming layers superposed on one another. If in a particular region one of these color-forming layers is imaged to $D_{max}$ whereas an adjacent color-forming layer is at $D_{min}$ (i.e., is unimaged), during prolonged projection of the slide, large amounts of heat will be generated by absorption of projector radiation in the $D_{max}$ layer, and this heat generation may cause development of unwanted color in the supposedly $D_{min}$ layer, thus leading to a change in color in this region.

The present inventors have found that these mechanical, optical and discoloration problems are essentially eliminated by forming an asymmetric slide blank, in which the color-forming layer is or layers are kept within a limited distance of an external surface of the slide blank, and the present invention is directed to such a slide blank, the slide produced therefrom and an imaging process using such a slide blank.

SUMMARY OF THE INVENTION

This invention provides a slide blank comprising:

a support at least part of which is essentially transparent;

an imageable layer superposed on one face of the support, the imageable layer not being substantially photosensitive but comprising a color-forming composition, which, upon imagewise exposure to actinic radiation, forms a colored material, thereby forming in the imageable layer an image which can be viewed in transmission; and a protective layer superposed on the imageable layer on the opposed side thereof from the support, at least part of the protective layer being essentially transparent;

the support, imageable layer and protective layer being secured together to form a slide blank having a thickness of at least about 0.8 mm, and the thickness of the protective layer being such that no part of the imageable layer containing the color-forming composition is more than about 0.2 mm from one external surface of the slide blank.

This invention also provides a slide comprising:

a support at least part of which is essentially transparent;

an image layer superposed on one face of the support and bearing an image which can be viewed in transmission; and a protective layer superposed on the image layer on the opposed side thereof from the support, at least part of the protective layer being essentially transparent;

the support, image layer and protective layer being secured together to form a slide having a thickness of at least about 0.8 mm, and the thickness of the protective layer being such that no part of the image layer containing the colored material which forms the image is more than about 0.2 mm from one external surface of the slide.

Finally, this invention provides a process for producing a slide, this process comprising providing a slide blank of the invention and forming in its imageable layer an image which can be viewed in transmission.

DETAILED DESCRIPTION OF THE INVENTION

Figure 1:
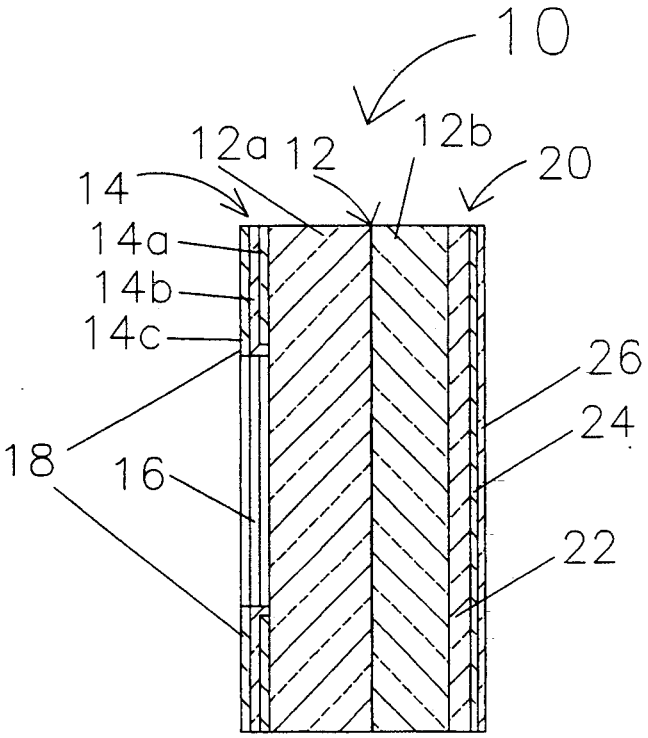
FIG. 1 is a schematic section through a first slide blank of the invention incorporating a direct-imaging single sheet medium, and the section being taken along the vertical center line of the slide blank (the line I—I in FIG. 2)

As already mentioned, the present invention provides a slide blank comprising a support, an imageable layer and a protective layer, all secured together with the imageable layer lying between the support and the protective layer. The overall thickness of the slide blank is at least about 0.8 mm, and is preferably at least about 1 mm, to render slides produced from the blank compatible with conventional slide projectors. The thickness of the protective layer is chosen so that no part of the imageable layer containing the color-forming composition is more than about 0.2 mm from one external surface of the slide blank; it is preferred that the thickness of the protective layer be chosen so that no part of the imageable layer containing the color-forming composition is more than about 0.15 mm, most desirably more than about 0.10 mm, from one external surface of the slide blank. Where multiple color-forming layers are present in the slide blank (for example, in a full color slide blank containing yellow, cyan and magenta color-forming layers), it is desirable that all parts of all layers containing a color-forming composition be within the specified distances from an external surface of the slide blank; this is not difficult to arrange since (as described below with reference to FIGS. 3 and 4) direct-imaging single sheet media can readily be produced in which the total thickness of three color-forming layers and the interlayers therebetween does not exceed about 25 μm (0.025 mm), so that protective layers having thicknesses more than sufficient to protect the color-forming layers can be provided without the color-forming layers being at too great a distance from the external surface of the slide blank.

As already noted, the protective layer of the present slide blank serves to protect the imageable layer from damage during handling and imaging of the slide blank, and handling and projection of the slide produced therefrom, and the thickness of the protective layer, and the material thereof, should of course be chosen to provide adequate protection of the imageable layer under the expected conditions of use. However, the protective layer may also fulfil another desirable function. As described in U.S. Pat. No. 5,342,816, and the corresponding International Application No. PCT/US92/02055 (Publication No. WO 92/19454), in some direct-imaging single sheet media, there is a tendency for strongly colored areas of the image which appear to be of the desired color when viewed in reflection to appear essentially black when viewed in transmission. This "blackening" of the image has been found to be due to the formation of bubbles in the color-forming layers, and can be reduced or eliminated by providing the imaging medium with a relatively thick bubble-suppressant layer or topcoat. In the present slide blank, the protective layer can also serve as the bubble-suppressant layer, thus eliminating any need to provide a separate bubble-suppressant layer in the imageable layer. To ensure that the protective layer is thick enough to serve as the bubble-suppressant layer, it is desirable that the protective layer have a thickness of at least about 10 μm, and preferably at least about 20 μm.

Obviously at least those pans of the support and the protective layer lying adjacent the area of the imageable layer which will form the image in the final slide must be essentially transparent so that projector radiation can pass through the protective layer, the image and the support when the slide is projected. Although we do not exclude the possibility of using partially opaque supports and/or protective layers in the present slide blank, in general it is preferred that the whole of both the support and the protective layer be essentially transparent, and that the slide blank include a mask layer (described in more detail below) to simulate a conventional slide mount. Polycarbonate plastics are preferred materials for the support, since they possess the requisite transparency and have physical properties that render them very suitable for use in the present slide blanks.

As discussed below, the present slide blank is well adapted to mass production by formation of the slide blanks in large sheets or on continuous webs, followed by separation of individual slide blanks from these sheets or webs, and the sheets or webs of slide blanks are conveniently prepared by laminating sheets or webs of support material, imageable layer material and protective layer material together. However, it is difficult to obtain commercially polycarbonate webs (continuous rolls) having a thickness of about 0.8–1 mm required to produce slides having the preferred thickness of about 1–1.2 mm, and, even if procurable, such polycarbonate webs are so rigid as to present handling difficulties with conventional web-handling machinery; for example, webs of this thickness cannot readily be wound on rolls, as required for use with roll-fed laminators, without roll set problems. Accordingly, it will often be convenient to form the support of the present slide blank from a plurality of sheets or webs of plastic or other material, these sheets or webs being secured to one another during manufacture of the slide blank. Any method providing a bond of sufficient strength to prevent delamination of the slide blank during imaging and use may be employed to attach the sheets or webs together to form the support (or indeed to attach the imageable layer to the support, or the protective layer to the imageable layer). Appropriate methods for securing the sheets or webs together include solvent bonding, heat sealing and other forms of adhesive bonding, for example the use of epoxy or silicone adhesives, pressure-sensitive adhesives or adhesives cured with ultraviolet or other radiation. It should be noted that the present slide blank imposes stringent requirements upon adhesives used to secure its various layers together, especially during projection of the final slide; during projection, large amounts of heat are generated within the slide by absorption of the projector radiation by the colored areas of the image, and unless the adhesive used is carefully chosen the heat generated may cause formation of bubbles or other artifacts within the adhesive layers, and such artifacts may show up on the projected image. When polycarbonate layers are used to form the support, it is presently preferred to bond the layers to each other by solvent bonding, for example using ketones as the solvents, as described in more detail below with reference to the drawings. When a plurality of sheets or webs are secured together to form the support, it is desirable that these sheets or webs be composed of the same material to avoid curl problems caused by differences in coefficients of thermal expansion.

The imageable layer of the present slide blank is not substantially photosensitive; "not substantially photosensitive" is used herein to indicate that the imageable layer is not imaged by approximately two minutes exposure to conventional indoor artificial lighting, so that the present slide can be handled without the need for light-tight enclosures.

Desirably, the support, imageable layer and protective layer of the present slide blank are of substantially the same dimensions and are secured together so that the imageable layer and the protective layer extend across substantially the whole area of the support. Such a slide blank is convenient to manufacture, since sheets or webs of material appropriate to form the support, imageable layer and protective layer of a plurality of slides can be laminated together by conventional techniques and the laminated sheets or webs then cut to produce individual slide blanks. Also, such a slide blank is readily made in the form of a flat lamina having two substantially planar major surfaces on opposed sides thereof, thus essentially eliminating the step between the thin film portion and the thick slide mount in a conventional slide, and the tendency for this step to gather dust, fibers and other detritus, or to catch on projections adjacent which the slide blank or slide passes. Although the slide blank can be made in any desired size, conveniently it is in the form of a substantially square lamina having an edge length of from about 40 to about 70 mm and a thickness of from about 0.8 to about 1.7 mm, preferably about 1 to about 1.2 mm; slide blanks having these dimension can produce slides that are compatible with conventional slide projectors.

In the present slide blank, the support serves to control the physical properties of the blank. The imageable layer and the protective layer are normally much thinner than the support, and the physical properties of the slide are largely those of the support. The support should be chosen to render the slide sufficiently rigid that it can be handled by conventional automated slide projectors without damage, but not so rigid that excessive forces are required to cause the slide to undergo the slight bending which is sometimes required during passage of the slide through automatic projectors, and which may also be desirable in apparatus used for imaging the slide blank. Indeed, it is an important advantage of the present slide blank that it can be deformed substantially during printing, but will return to a planar form after printing. Typically, the present slide blank will be printed by one or more spots of radiation (for example focussed laser beams) which are scanned in a raster pattern over at least the central portion of the imageable layer and modulated to form the image. Conveniently, movement of the spots in the fast scan direction of the raster pattern is achieved by deflecting the beam with an oscillating mirror. However, if the slide blank has to be maintained planar during priming, the variation in distance between the axis of oscillation of the mirror and the slide blank will result in some parts of the image being out of focus unless an expensive, aspherical, $f(\theta)$ lens is used to focus the beam. If, on the other hand, the slide blank can be deformed so that the imageable layer has the form of part of the surface of a cylinder having its axis coincident with the axis of oscillation of the mirror, each part of a scan line can be at the same distance from the axis of oscillation and an inexpensive spherical lens can be used to focus the beam. (It is not necessary to bend the slide blank in both dimensions, since movement of the spots in the slow scan direction can readily be effected by moving the entire slide relative to the mirror, for example by means of a stepper motor.) Bending of the present slide to a constant radius in this manner is facilitated by the essentially constant thickness of the slide; a structure resembling a conventional slide with a central window containing a section of imaging medium and surrounded by a much thicker frame cannot readily be bent to a curve of constant radius. (If the slide blank includes a mask layer, as discussed below, the very small difference between the thickness of the portion of the slide blank containing the central portion of the mask layer and that containing the peripheral portion of the mask layer is too small to affect the bending properties of the slide blank.)

The imageable layer of the present slide blank may be of any type which is not substantially photosensitive but is imageable through the protective layer to form an image that can be viewed in transmission (for reasons discussed above, optical considerations render it desirable to image through the protective layer) Obviously, since the imageable layer must be imaged while still covered by the protective layer, the imageable layer cannot be of a type which requires post-imaging treatment with liquid reagents to produce a visible image. However, the imageable layer may be of a type (for example that described below with reference to FIG. 4) which requires heating and/or blanket exposure to radiation of particular wavelengths before or after imagewise exposure to the image-forming radiation, since such blanket exposures can readily be effected through an appropriate protective layer, and the protective layer can be made sufficiently thin to allow heating of the imageable layer by conduction through the protective layer without damage to the slide blank. Desirably, the color-forming composition comprises a radiation absorber capable of absorbing actinic radiation (preferably infra-red radiation having a wavelength in the range of about 700 to about 1200 nm, since infra-red lasers having wavelengths within this range are excellent sources of imaging radiation) and a leuco dye which, upon absorption of radiation by the radiation absorber, forms the colored material. In one type of such compositions described, for example, in the aforementioned U.S. Pat. Nos. 4,602,263; 4,720,449; 4,720,450; 4,745,046; 4,818,742; 4,826,976; 4,839,335; 4,894,358 and 4,960,901, the radiation absorber generates heat within the imageable layer, and the leuco dye undergoes a thermal reaction to form the colored material. In this type of composition, the leuco dye may be, for example:

a. an organic compound capable of undergoing, upon heating, an irreversible unimolecular fragmentation of at least one thermally unstable carbamate moiety, this organic compound initially absorbing radiation in the visible or the non-visible region of the electromagnetic spectrum, the unimolecular fragmentation visibly changing the appearance of the organic compound (see U.S. Pat. No. 4,602,263);

b. a substantially colorless di- or triarylmethane imaging compound possessing within its di- or triarylmethane structure an aryl group substituted in the ortho position to the meso carbon atom with a moiety ring-closed on the meso carbon atom to form a 5- or 6-membered ring, the moiety possessing a nitrogen atom bonded directly to the meso carbon atom and the nitrogen atom being bound to a group with a masked acyl substituent that undergoes fragmentation upon heating to liberate the acyl group for effecting intramolecular acylation of the nitrogen atom to form a new group in the ortho position that cannot bond to the meso carbon atom, whereby the di- or triarylmethane compound is rendered colored (see U.S. Pat. No. 4,720,449);

c. a colored di- or triarylmethane imaging compound possessing within its di- or triarylmethane structure an aryl group substituted in the ortho position to the meso carbon atom with a thermally unstable urea moiety, the urea moiety undergoing a unimolecular fragmentation reaction upon heating to provide a new group in the ortho position that bonds to the meso carbon atom to form a ring having 5 or 6 members, whereby the di- or triarylmethane compound becomes ting-closed and rendered colorless (see U.S. Pat. No. 4,720,450);

d. in combination, a substantially colorless di- or triarylmethane compound possessing on the meso carbon atom within its di- or triarylmethane structure an aryl group substituted in the ortho position with a nucleophilic moiety which is ringclosed on the meso carbon atom, and an electrophilic reagent which upon heating and contacting the di- or triarylmethane compound undergoes a bimolecular nucleophilic substitution reaction with the nucleophilic moiety to form a colored, ting-opened di- or triarylmethane compound (see U.S. Pat. No. 4,745,046);

e. a compound of the formula $$[M'-(X)_q]_p-D$$

wherein M' has the formula:

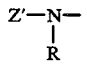

wherein R is alkyl; $-SO_2R^1$ wherein $R^1$ is alkyl; phenyl; naphthyl; or phenyl substituted with alkyl, alkoxy, halo, trifluoromethyl, cyano, nitro, carboxyl, $-CONR^2R^3$ wherein $R^2$ and $R^3$ each are hydrogen or alkyl, $-CO_2R^4$ wherein $R^4$ is alkyl or phenyl, $-COR^5$ wherein $R^5$ is amino, alkyl or phenyl, $-NR^6R^7$ wherein $R^6$ and $R^7$ each are hydrogen or alkyl, $-SO_2NR^8R^9$ wherein $R^8$ and $R^9$ each are hydrogen, alkyl or benzyl; Z' has the formula:

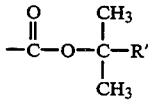

wherein R' is halomethyl or alkyl; X is —N=, $-SO_2-$ or $-CH_2-$; D taken with X and M' represents the radical of a color-shifted organic dye; q is 0 or 1; and p is a whole number of at least 1; Z' being removed from M' upon the application of heat to effect a visually discernible change in spectral absorption characteristics of the dye (see U.S. Pat. No. 4,826,976);

f. substantially colorless di- or triarylmethane compound of the formula:

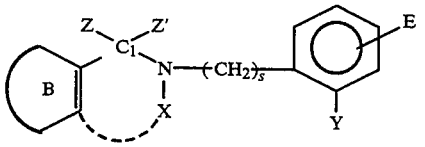

wherein ring B represents a carbocyclic aryl ring or a heterocyclic aryl ring; $C_1$ represents the meso carbon atom of the di- or triarylmethane compound; X represents —C(=O)—; $-SO_2-$ or $-CH_2-$ and completes a moiety ting-closed on the meso carbon atom, the moiety including the nitrogen atom bonded directly to the meso carbon atom; Y represents —NH—C(=O)—L, wherein L is a leaving group that departs upon thermal fragmentation to unmask —N=C=O for effecting intramolecular acylation of the nitrogen atom to open the N-containing ring and form a new group in the ortho position of ring B that cannot bond to the meso carbon atom; E is hydrogen, an electron-donating group, an electron-withdrawing group or a group, either an electron-donating group or an electron-neutral group that undergoes fragmentation upon heating to liberate an electron-withdrawing group; s is 0 or 1; and Z and Z' taken individually represent the moieties to complete the auxochromic system of a diarylmethane or triarylmethane dye when the N-containing ring is open, and Z and Z' taken together represent the bridged moieties to complete the auxochromic system of a bridged triarylmethane dye when the N-containing ring is open (see U.S. Pat. No. 4,960,901);

g. a colorless precursor of a preformed image dye substituted with (a) at least one thermally removable protecting group that undergoes fragmentation from the precursor upon heating and (b) at least one leaving group that is irreversibly eliminated from the precursor upon heating, provided that neither the protecting group nor the leaving group is hydrogen, the protecting and leaving groups maintaining the precursor in its colorless form until heat is applied to effect removal of the protecting and leaving groups whereby the colorless precursor is converted to an image dye;

h. a mixed carbonate ester of a quinophthalone dye and a tertiary alkanol containing not more than about 9 carbon atoms (see U.S. Pat. No. 5,243,052);

i. a leuco dye represented by:

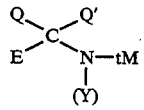

wherein:

E represents a thermally removable leaving group;

tM represents a thermally migratable acyl group;

Q, Q' and C taken together represent a dye-forming coupler moiety wherein C is the coupling carbon of the coupler moiety;

and, (Y) taken together with N represents an aromatic amino color developer, one of Q, Q' and (Y) containing an atom selected from the atoms comprising Group 5A/Group 6A of the Periodic Table, the groups E and tM maintaining the leuco dye in a substantially colorless form until the application of heat causes the group E to be eliminated from the leuco dye and the group tM to migrate from the N atom to the Group 5A/Group 6A atom thereby forming a dye represented by:

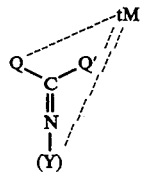

wherein the dotted lines indicate that the tM group is bonded to the Group 5A/Group 6A atom in one of Q, Q' and (Y) (see U.S. Pat. No. 5,236,884).

U.S. Pat. Nos. 5,278,031; 5,286,612; 5,334,489 and 5,395,736, and application Ser. No. 08/141/852, and in the corresponding International Applications Nos. PCT/US93/10093, PCT/US93/10224 and PCT/US93/10215 (Publication Nos. WO 94/09992, WO 94/10607 and WO 94/10606 respectively), upon absorption of the actinic radiation, the radiation absorber generates acid within the imageable layer, and, upon exposure to this acid, the leuco dye forms the colored material. The acid may be generated by direct thermal breakdown of an acid generating material, for example a squaric acid derivative or a sulfonate (see International Application No. PCT/US93/10093), or by direct decomposition of a superacid precursor by actinic (typically ultra-violet) radiation followed by "amplification" of the superacid produced by superacid-catalyzed thermal decomposition of a secondary acid generator (see International Application No. PCT/US93/10224). Alternatively, (see International Application No. PCT/US93/10215), the color-forming composition may comprise a superacid precursor capable of being decomposed, by radiation of a wavelength shorter than that of the actinic radiation absorbed by the radiation absorber, to form a superacid, the superacid precursor, in the absence of the radiation absorber, not being decomposed by the actinic radiation absorbed by the radiation absorber but, in the presence of the radiation absorber and the actinic radiation absorbed by the radiation absorber, decomposing to form a protonated product derived from the radiation absorber, the color-forming composition further comprising a secondary acid generator capable of being thermally decomposed to form a second acid, the thermal decomposition of the secondary acid generator being catalyzed in the presence of the superacid derived from the superacid precursor. This type of medium is first imagewise exposed to radiation (typically infra-red radiation) of a wavelength which is absorbed by the radiation absorber, thereby producing, in the exposed regions, a protonated product derived from the absorber; in effect, the absorber causes decomposition of the superacid precursor with the formation of superacid buffered by the dye. The medium is then given a second exposure to radiation (typically ultra-violet radiation) of a wavelength which brings about decomposition of the superacid precursor. The second exposure is controlled so that in the areas exposed during the first exposure, unbuffered superacid is present after the second exposure, whereas in the areas not exposed during the first exposure, only buffered superacid is present following the second exposure. Thus, the double exposure effectively produces an image in unbuffered superacid. Following the second exposure, the imaging medium is normally heated so that the unbuffered superacid can catalyze the thermal breakdown of a secondary acid generator, thereby producing, in the areas exposed during the first exposure, a large concentration of a secondary acid, which produces color in an acid-sensitive leuco dye.

Any of the aforementioned types of imaging medium comprising a color-forming composition which, upon exposure to actinic radiation, forms a colored material, may be rendered capable of producing multicolored images by providing a plurality of imageable layers, each of these imageable layers being capable of generating a different color, and each of these imageable layers having a radiation absorber capable of absorbing actinic radiation of a wavelength different from that of the radiation absorbed by the radiation absorber present in each of the other imageable layers. Such an imaging medium can be imaged using multiple lasers (or other light sources) having wavelengths arranged so that each laser is only absorbed by one of the imageable layers, thereby enabling the various imageable layers to be imaged independently of one another.

The protective layer used in the present slide blank may be formed from any material which has the physical properties (for example, hardness and resistance to abrasion) needed to protect the imageable layer from damage under the conditions expected during imaging and projection of the slide. If, as will normally be the case, the imageable layer is to be imaged through the protective layer, the protective layer must be substantially transparent to the imaging radiation, and have optical properties (e.g., lack of birefringence, and lack of optical heterogeneities) which do not interfere with the imaging process. Desirably, the protective layer incorporates an ultra-violet absorber to reduce the amount of ultra-violet radiation reaching the imageable layer, since certain direct-imaging single sheet media have been found to be somewhat susceptible to color changes upon substantial exposure to ultra-violet radiation. The protective layer may be laminated to the imageable layer or may be formed by coating on to the imageable layer; in either case, it is often convenient to first form the imageable layer and the protective layer as a single unit, and then to laminate this unit to the support. If the protective layer is secured to the imageable layer by lamination, the protective layer is conveniently formed of a plastic material, for example poly(ethylene terephthalate), while a protective layer formed by coating is conveniently formed by coating an aqueous polyurethane dispersion.

As already mentioned, desirably the slide blank of the present invention comprises a mask layer as described in the aforementioned copending application Ser. No. 08/226,452, this mask layer having a substantially transparent central portion and a non-transparent, preferably opaque, peripheral portion surrounding its transparent central portion. Thus, the mask layer mimics the appearance of a conventional slide mount, having a central window and a non-transparent periphery. The transparent portion of the mask layer may be formed of transparent material or may simply have the form of an aperture extending through the mask layer. The support, imageable layer and protective layer extend across essentially the entire transparent central portion of the mask layer, with the transparent portions of the support and the protective layer disposed adjacent the transparent central portion of the mask layer, so that an image formed in the imageable layer can be viewed in transmission through the transparent central portions of the support, mask layer and protective layer, in the same manner as a conventional mounted slide.

The position of the mask layer within the slide blank can vary, provided this position is consistent with the requirements for imaging of the imageable layer used. For example, the mask layer can be in contact with one face of the support and the imageable layer superposed upon the mask layer. The arrangement places the mask layer and the imageable layer close together, thus minimizing any potential problems which may be caused by separation of these two layers during projection of the slide produced from the blank; such problems may, at least in theory, include an indistinct edge of the mask layer caused by its separation from the focal plane of the projector lens, since the user of the slide naturally aligns this focal plane with the imaged layer. However, placing the mask layer within the slide blank in this manner may cause problems if it is desired to use a mask layer having a central aperture, since this aperture will cause a void within the slide, which could distort the projected image. Even if the central aperture is filled with adhesive during manufacture of the slide blank, undesirable optical artifacts could be produced by bubbles, dirt or changes in refractive index within the adhesive layer. In addition, sometimes it may be difficult to place a thin imageable layer over the mask layer without producing undesirable distortion of the imageable layer, which may cause difficulty in imaging this layer. Accordingly, in general it is preferred that the slide blank of the present invention have the mask layer disposed on the opposed side of the support from the imageable layer. In slide blanks having the preferred thickness of about 1 to 1.2 mm, it has been found that the separation of the mask layer from the imageable layer by the support does not, in practice, cause an objectionable degree of fuzziness in the edges of the mask layer seen in the projected image, and the fact that the imageable layer and the mask layer are placed upon different faces of the support, rather than the imageable layer being placed upon the mask layer, or vice versa, facilitates the attachment of both layers to the support. Any slight degree of fuzziness in the edges of the mask layer caused by the separation between the mask layer and the imageable layer may be dealt with by imaging a black border around the image, this black border forming, visually, an extension of the mask layer; the use of such borders is discussed in more detail below. Although placing a mask layer having a central aperture on one external surface of the slide blank does leave a small step around the central aperture, with the preferred printed form of mask layer (discussed in detail below), this step is very small (of the order of microns) and is thus much less likely to gather dirt, or to catch on projection apparatus, than the much larger steps found in conventional slides. Also, as already noted, the small difference in thickness between the parts of the slide introduced by this step does not affect the ability of the slide to be deformed to a curved surface during imaging.

The mask layer of the present slide blank can be formed from any material, which is sufficiently opaque, and which possesses the requisite physical properties, to form a dark, well-defined "frame" when a slide produced from the blank is projected using a conventional slide projector. For example, the mask layer may be formed from a layer of opaque plastic, but is preferably formed by printing a layer of ink or other pigment on to one face of the support, conveniently by silk screening. Alternatively, the mask layer may be formed from a metal foil, preferably applied by a hot stamping process. Such metal foils are inexpensive and readily available commercially. Furthermore, such printed layers or foils can be made extremely thin (about 1 to about 2 μm) yet still opaque, so that when such a printed layer or foil is used as a mask layer on an external surface of the slide blank the step between the central aperture and the mask layer is essentially eliminated. Printed layers and metal foils also have the advantage that they can be colored and patterned so that the appearance of the slide blank can be customized as desired. Thus, for example, the printed layer or foil can display a corporate logo, or other identifying indicium indicating its source or ownership. Whether or not a printed layer or foil is used to form the mask layer, advantageously the two major surfaces of the mask layer differ in color, thus assisting the user to place the completed slide in a projector in the proper manner without turning it over and producing an image that is left-right reversed.

As already mentioned, the slide blank of the present invention is well-adapted to mass production since the support, imageable layer, protective and mask layer (if present) can be assembled and secured to each other in large sheets or webs, and individual slides thereafter cut from these sheets or webs by conventional processes, for example die cutting. (Obviously, the cutting of the sheets must be done so that the transparent central portion of the mask layer is in the correct position in the finished slide blank, but it is well within the skill of the art to provide automated detection of the position of the central portion of the mask layer and to control the cutting process accordingly.) Moreover, since the imageable layer in the present slide blank typically extends across the whole face of the slide blank (and thus beyond the central portion of the mask layer, if this mask layer is present), the peripheral part of the imageable layer is available for imaging, at least part of this peripheral part of the imageable layer can be used as a legend portion. If a mask layer is present in the slide blank, an image formed on the legend portion can be viewed in reflection against the background provided by the mask layer. This legend portion is very convenient for providing identifying indicia on the slide, since (as those skilled in the electronic imaging art will be aware) software can readily be written to print both an image within the central portion of the imageable layer and an image on the legend portion in a single imaging operation, thus permanently associating the identifying indicia in the legend portion with the main image on the central portion. Moreover, the size of the legend portion can be substantial, sufficient to accommodate 2 or 3 lines of 10–12 point type, and thus the identifying indicia could comprise, for example, a slide number, a date and several words of description, thus facilitating identification and use of the slide.

The present slide blank allows variation of the size and shape of the image formed thereon during printing; assuming that the imageable layer can achieve a maximum optical density sufficient to render a black portion of the image essentially indistinguishable from the frame of a conventional slide during projection, one or more portions of the imageable layer may be rendered substantially opaque during formation of the image, so that the image as seen in transmission is delimited, in whole or in part, by these opaque portions of the imageable layer. Such delimitation of the image by opaque portions may be used as an alternative to, or in conjunction with, a mask layer to simulate the mount of a conventional slide. For example, a slide of the present invention could have no mask layer but use a totally transparent support and protective layer, with all portions of the imageable layer other than the central portion containing the image to be viewed rendered opaque during imaging. More commonly, however, the present slide blank will contain a mask layer which has a transparent central portion differing in at least one of size, shape and aspect ratio from the final image to be produced on the slide blank, an opaque portion will be formed in the imageable layer to block transmission of light through those parts of the slide lying within the transparent central portion of the mask layer but outside the final image to be projected. For example, a slide blank of the present invention may be provided with a large, square central portion of the mask layer and during printing either top and bottom areas, or left and right side areas, of this central portion could be colored solid black during printing, thereby allowing the slide blank to accommodate rectangular images in both landscape and portrait orientations, while still keeping the image the same way up on the slide. This form of "dual mode" slide blank allows the use of images in both orientations without the user worrying about whether any specific slide needs to be turned sideways before projection. Obviously, such a slide blank might also be useful for adapting to rectangular images with aspect ratios differing from those of conventional portrait or landscape images, and non-rectangular or unusually shaped images, for example, heart-shaped wedding photographs. Also, as mentioned above, the image to be projected may be surrounded by a black border to avoid any problem of fuzziness in the edge of the mask layer as seen during projection of the slide.

Preferred slide blanks of the present invention, and processes for their preparation, will now be described in more detail, though by way of illustration only, with reference to the accompanying drawings.

Figure 2:
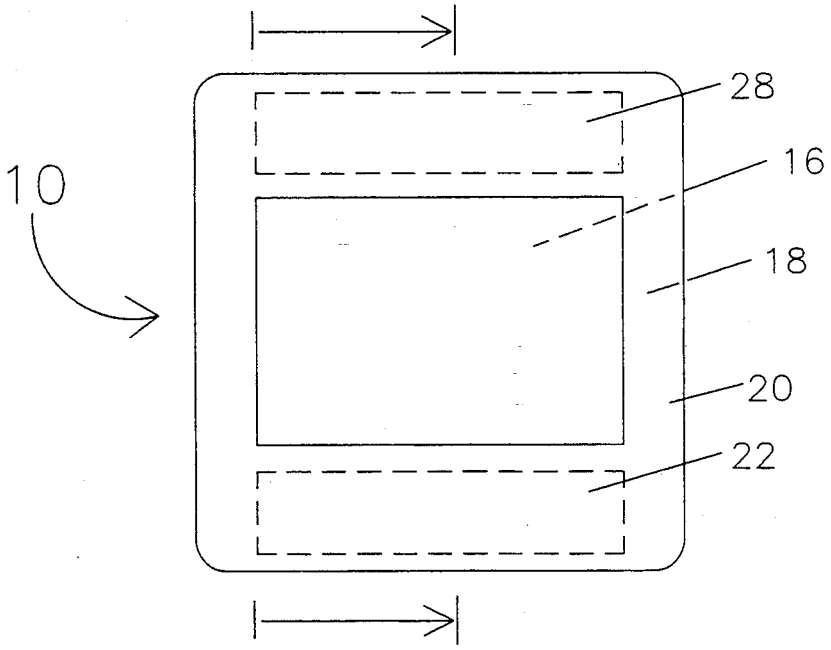
FIG. 2 is a front elevation of the slide blank shown in FIG. 1, looking from the right in that Figure.

The first slide blank of the invention, shown in FIGS. 1 and 2 and generally designated 10, is intended for laser imaging and comprises a support 12 formed from two transparent sheets 12*a* and 12*b*, each of which is formed of polycarbonate, the two sheets 12*a* and 12*b* being solvent bonded to one another. (In FIGS. 1 and 3–6, for ease of illustration the thicknesses of the various layers of imaging media and slide blanks are exaggerated compared with their lengths and widths.) The first sheet 12*a* is 20 mil (0.5 mm) thick, while the second sheet 12*b* is 15 mil (0.38 mm) thick. To the outer surface of the sheet 12*a* is adhesively secured a mask layer 14 having a substantially transparent, rectangular central portion 16 and a non-transparent peripheral portion 18 surrounding the central portion.

To the outer surface of the sheet 12*b* (the surface remote from the sheet 12*a*) is adhesively secured an imageable layer 20 in the form of a direct imaging single sheet medium, and a protective layer 26. The support 12, the mask layer 14, the imageable layer 20 and the protective layer 26 are secured together so that the support and the imageable layer extend across the entire central portion 16 of the mask layer. Also, since the imageable layer 20 extends across the entire face of the slide 10, portions of the imageable layer 20 lying adjacent the peripheral portion 18 of the mask layer 14, for example the portions within the dashed areas 28 in FIG. 2, can be imaged (in the same scan as the portion of the imageable layer 20 lying adjacent the central portion 18 of the mask layer 14) to provide legend areas bearing identifying indicia for the slide.

It will be seen from FIG. 2 that the first slide blank has an appearance substantially mimicking that of a conventional mounted slide, except of course that the slide blank lacks an image thereon. Since the imageable layer 20, the protective layer 26 and the support 12 are essentially transparent, an observer viewing the elevation of the slide blank shown in FIG. 2 (which is the view normally regarded as the front of a conventional slide, i.e., the side which faces the projector bulb during projection) sees the central portion 16 of the mask layer 14 as a central "window" or piece of film surrounded by a slide mount or "frame" provided by the peripheral portion 18 of the mask layer 14. In a slide produced by printing on such a slide blank, any legend printed in the legend areas 28 is seen in reflection against the peripheral portion 18, and thus appears to be printed on the frame of the slide.

It will be seen from FIG. 1 that both the mask layer 14 and the imageable layer 20 comprise a plurality of layers in this embodiment of the invention. The mask layer 14 is formed by successively silk screen printing on to the first sheet 12*a* three separate layers, namely a white layer 14*a*, a blue layer 14*b* and a grey layer 14*c*; the transparent central portion 16 is formed simply by not printing the layers 14*a*, 14*b* and 14*c* on the central portion of the slide blank. The white and grey layers 14*a* and 14*c* respectively cause the appearance of the slide blank to resemble closely that of a normal mounted slide, which typically is white on one surface and grey on the other; since the polycarbonate sheets 12*a* and 12*b* are transparent, as are non-imaged portions of the imageable layer 20, a user viewing the slide blank 10 from the side bearing the imageable layer sees mainly the white layer 14*a*. The difference in color between the two faces of the slide assists the user in correctly orienting the slide, with the white face and the imageable layer 20 facing the projector bulb. The provision of the white layer facing the projector bulb reduces heat generation within the slide during projection, since the white layer reflects most of the projector radiation striking it, and thus minimizes any chance of heat buildup within the slide affecting a thermally sensitive imaging layer. The central aperture in the blue layer 14*b* is made slightly smaller than that in the white layer 14*a*, since it has been found that having a blue layer present avoids esthetic problems which might otherwise result from slight misregistration between the grey and white layers, i.e., the appearance of a narrow strip of white on the grey side of the slide, or a narrow strip of grey on the white side of the slide. If desired, portions of the grey layer 14*c* can be imagewise omitted so that portions of the blue layer 14*b* appear through the grey layer 14*c*, thereby presenting any desired image (for example, a corporate logo) on the rear surface of the slide. Also, a transparent protective layer may be applied over the grey layer 14*c* to protect the mask layer 14 from damage during imaging and handling of the slide blank or slide produced therefrom.

The imageable layer or imaging medium 20 comprises a base (or support) 22 having a thickness of 5 mil (0.13 mm) and formed from the same polycarbonate as the sheets 12*a* and 12*b*; this base 22 is solvent bonded to the second sheet 12*b* so that it effectively becomes part of the support in the finished slide blank 10. The imageable layer further comprises color-forming layers, which are shown as a single layer 24 in FIG. 1 for ease of illustration. The protective layer or topcoat 26 of the imaging medium forms one external surface of the slide blank, and serves to protect the relatively fragile color-forming layers 24 from damage caused by handling of the slide blank.

The slide blank 10 can conveniently be mass produced from sheets or, preferably, continuous webs of material. The imaging medium 20 and the topcoat 26 are first prepared as a single unit by coating and lamination in the manner described below. The mask layer 14 is silk screen printed on to a web of the first sheet 12*a*, and the resultant printed web is solvent bonded to a web of the second sheet 12*b* using methyl ethyl ketone. The sheets thus joined are immediately solvent bonded to the support 22 of the imaging medium 20 using methyl propyl ketone, which has been found to produce more uniform lamination than methyl ethyl ketone in this case. Finally, individual slide blanks are cut from the resultant web. It has been found empirically that the slide blank produced in this manner is sufficiently rigid to resemble a conventional mounted slide, and be usable in conventional slide projectors without modification of the projector, but sufficiently flexible to allow some bending of the slide blank during printing.

The thickness of the topcoat 26 is controlled so that all parts of the color-forming layers 24 lie within 0.10 mm of one external surface of the slide blank, namely the exposed face of the topcoat 26. This location of the color-forming layers 24 adjacent an external surface of the slide allows for efficient dissipation of heat caused by absorption of projector radiation in the imaged color-forming layers when a slide produced from the slide blank is projected, and thus prevents overheating and possible damage to the color-forming layers. Furthermore, this position of the color-forming layers reduces any tendency for the slide blank to delaminate at the relatively weak color-forming layers, and greatly reduces the optical problems caused by variations in the thickness of the protective layer through which the color-forming layers must be imaged.

As noted above, the slide blank 10 is designed so that the base 22 of the imaging medium 20 effectively becomes part of the support in the finished slide blank, and thus the base 22 is formed from the same polycarbonate as the first and second sheets 12*a* and 12*b* respectively. It will be appreciated that the base 22 need not be of the same material as the sheets 12*a* and 12*b*; if desired, the sheet 12*b* could be made thicker and a much thinner material, which need not be polycarbonate, used as the base 22, provided of course that the material chosen for the base 22 can form a strong bond to the polycarbonate sheet 12*b*. Also, the topcoat 26 need not be joined with the imaging medium 20 prior to assembly of the slide blank, but could be a separate layer applied over and bonded to the imaging medium as the imaging medium is incorporated into the slide blank (see the description of FIGS. 5 and 6 below).

Figure 5:
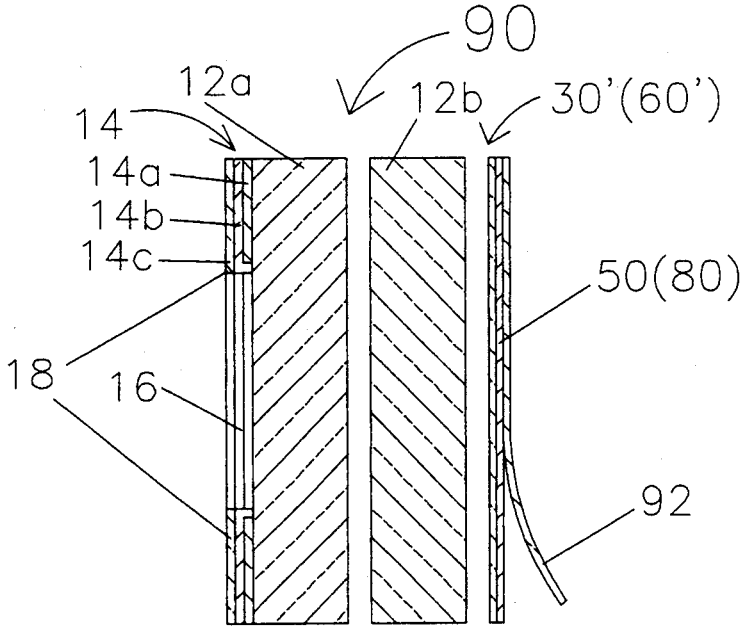
FIG. 5 is a schematic section through a second slide blank of the invention incorporating an imaging medium as shown in FIG. 3 or FIG. 4, the slide blank being shown as the various layers thereof are being assembled.
Figure 6:
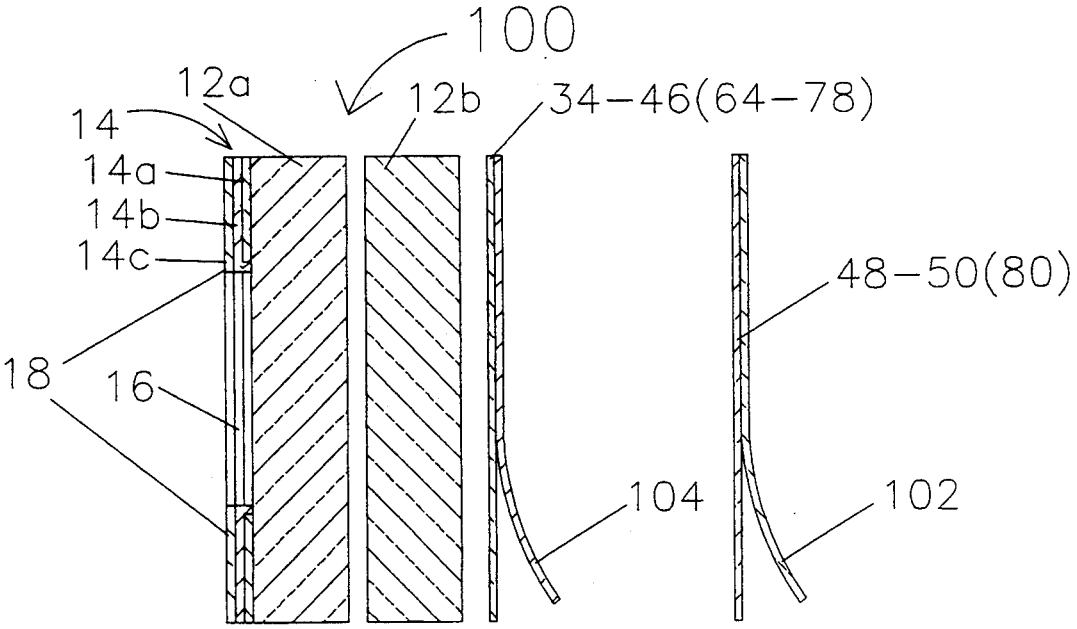
FIG. 6 is a schematic section, similar to that of FIG. 5, through a third slide blank of the invention incorporating a modified form of the imaging medium shown in FIG. 3 or FIG. 4.

The front elevations of the second and third slide blanks of the invention shown in FIGS. 5 and 6 respectively are essentially identical to that of the first slide blank shown in FIG. 2, and hence these additional front elevations will not be separately illustrated herein.

Figure 3:
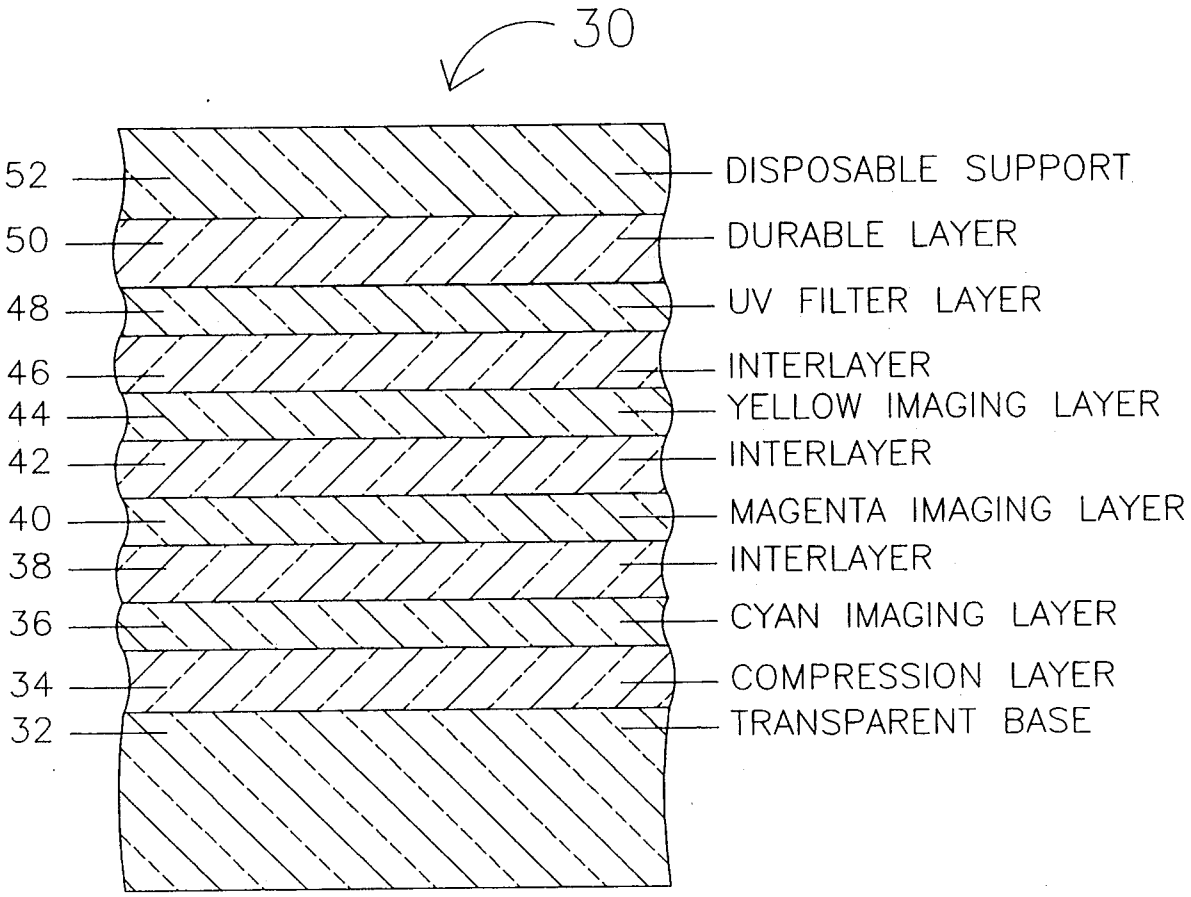
FIG. 3 is a schematic section through the imageable layers of a direct-imaging single sheet medium as described in copending application Ser. No. 08/065,350, filed May 20, 1993, this medium being usable in the slide blank shown in FIGS. 1 and 2.
Figure 4:
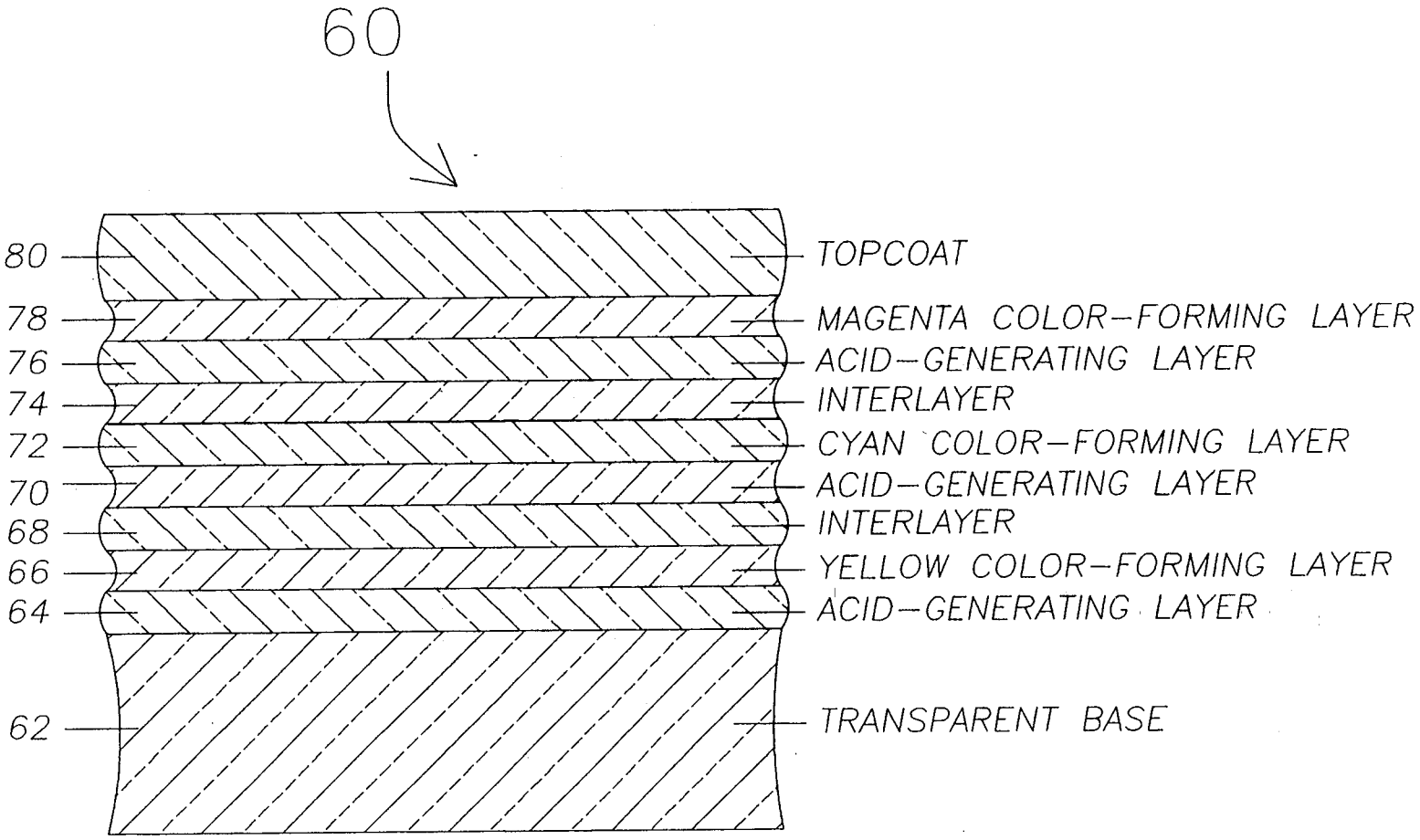
FIG. 4 is a schematic section through the imageable layers of a direct-imaging single sheet medium as described in copending application Ser. No. 08/141,852, filed Oct. 22, 1993 (and in the corresponding International Application No. PCT/US93/10215, filed on the same day), this medium being usable in the slide blank shown in FIGS. 1 and 2.

FIGS. 3 and 4 of the accompanying drawings illustrate imaging media which can be used as the imageable layer 20 and topcoat 26 in the slide blank shown in FIGS. 1 and 2. The imaging medium (generally designated 30) shown in FIG. 3 is of the type described in the aforementioned copending application Ser. No. 08/065,350, and is designed so that the various layers thereof can be coated without the use of organic solvents. The imaging medium 30 comprises a substantially transparent base 32 formed of 5 mil (126 μm) polycarbonate film incorporating an ultra-violet absorber; it is this base 32 which forms the base 22 of the imageable layer in the slide blank 10 shown in FIGS. 1 and 2. (The thicknesses of the layers 34–52 (described below) are exaggerated in FIG. 3 relative to the thickness of the base 32.) Appropriate polycarbonate films are readily available commercially.

On the base 32 is coated, from an aqueous polyurethane dispersion, a compression layer 34, which is approximately 6 μm thick. The compression layer 34 is designed to prevent cracking of the relatively fragile imaging layers (described below) when a slide blank incorporating the imaging medium 30 is bent, for example during printing of the slide blank. It has been found that the presence of a soft, flexible compression layer 30 reduces the tendency for the imaging layers to crack during bending of the slide blank.

A cyan imaging layer 36 is in contact with the compression layer 34. To prepare the cyan imaging layer 36, 52.24 parts by weight of a leuco dye of formula:

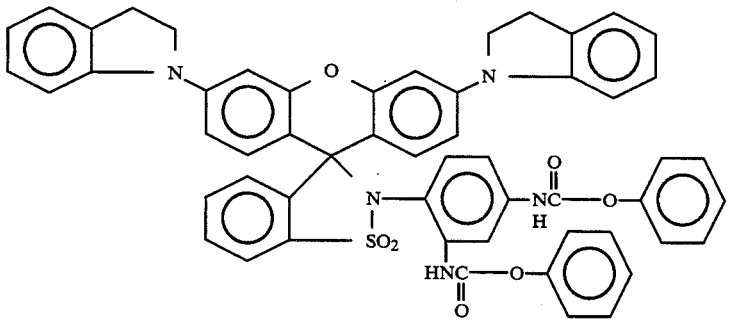

(this leuco dye may be prepared by the methods described in U.S. Pat. Nos. 4,720,449 and 4,960,901), 2.37 parts by weight of an infra-red dye of formula:

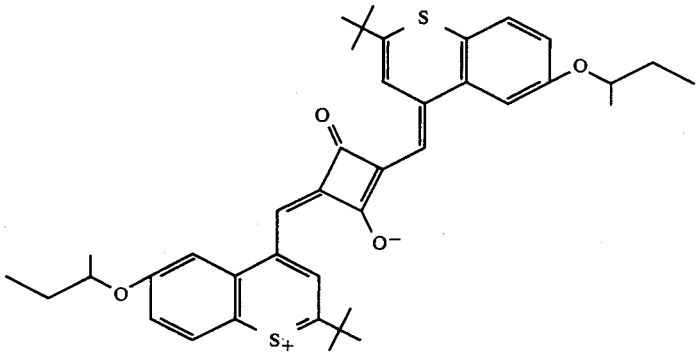

(prepared as described in the aforementioned application Ser. No. 08/065,350), 1.6 parts by weight of a hindered amine light stabilizer (HALS-63, sold by Fairmount Chemical Co., Inc., 117 Blanchard Street, Newark, N.J. 07105), 7.84 parts by weight of di-tert-butyl hydroquinone (a light stabilizer), 12.82 parts by weight of a surfactant (Aerosol TR-70, supplied by American Cyanamid Co., Wayne, N.J. 07470, with pH adjusted to 5.6 using a 1.0M aqueous solution of sodium hydroxide) and 31.32 parts by weight of a poly(ethyl methacrylate) binder (Elvacite 2043, sold by E. I. DuPont de Nemours and Company, Wilmington, Del.) were dissolved in 1282 parts by weight of dichloromethane. 1134 Parts by weight of deionized water were added to this solution, and the resulting mixture was homogenized. The dichloromethane was then removed by rotary evaporation under reduced pressure to leave a dispersion in water of particles whose size was in the 100–300 nm range. A water-soluble binder, poly(vinyl alcohol) (Airvol 540, supplied by Air Products, Allentown, Pa. parts by weight of a 25% aqueous solution) to provide the coating fluid. To form the cyan color-forming layer 36, this coating fluid was coated to a dried coating weight of 360 mg/ft$^2$.

The next layer of the imaging medium 30 is an interlayer 38, which is formed from a 2:1 w/w mixture of two water-soluble acrylic polymers, (Carboset XL-37 and Carboset 526, both sold by B. F. Goodrich Co., Akron Ohio 44313). The interlayer 38 is coated on to the cyan layer 36 from aqueous solution at a dried coating weight of 437 mg/ft$^2$. This interlayer 38 serves as a thermal insulator to prevent coloration of the cyan imaging layer by heat generated during exposure of the magenta imaging layer (and vice versa). The interlayer 38 also serves to reduce or eliminate migration of dye compound from the cyan and magenta imaging layers, and to increase adhesion between these layers.

Superposed on the interlayer 38 is a magenta imaging layer 40. To prepare the magenta imaging layer 40, 45 parts by weight of a leuco dye of formula:

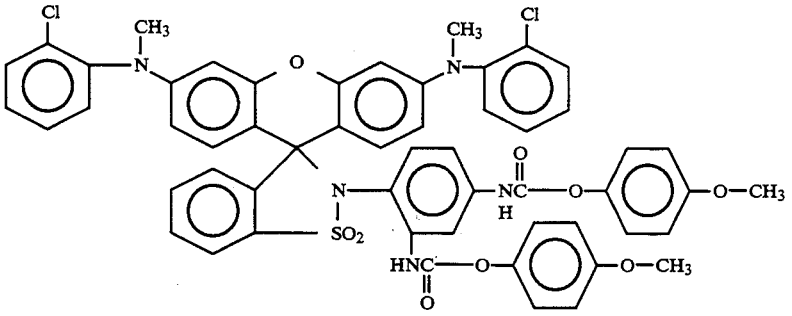

18195, 219.3 parts by weight of a 9.8% aqueous solution) was added to 1200 parts by weight of the dispersion prepared above, followed by a fluorinated surfactant (FC-120, supplied by the Minnesota Mining and Manufacturing Corporation, Minneapolis, Minn., 1.23 (this leuco dye may be prepared by the methods described in the aforementioned U.S. Pat. Nos. 4,720,449 and 4,960,901), 1.875 parts by weight of an infra-red dye of formula:

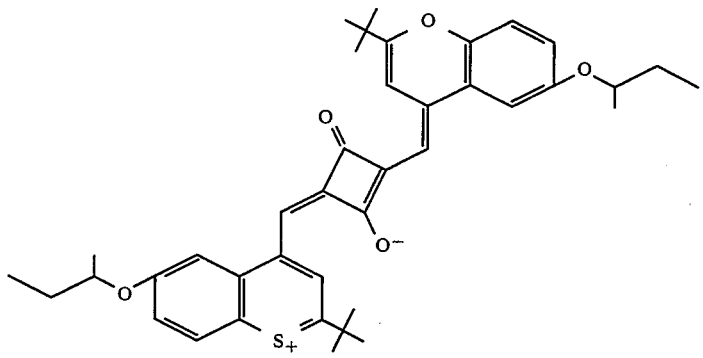

(prepared as described in the aforementioned application Ser. No. 08/065,350), 1.725 parts by weight of a hindered amine light stabilizer HALS-63, 11.275 parts by weight of a surfactant (Aerosol TR-70, with pH adjusted to 5.6 using a 1.0M aqueous solution of sodium hydroxide) and 33.9 parts by weight of a poly(ethyl methacrylate) binder (Elvacite 2043) were dissolved in 1060 parts by weight of dichloromethane. 1125 Parts by weight of deionized water were added to this solution, and the resulting mixture was homogenized. The dichloromethane was then removed by rotary evaporation under reduced pressure to leave a dispersion in water of particles whose size was in the 100–300 nm range. A water-soluble binder, poly(vinyl alcohol) (Airvol 540, 195.3 parts by weight of a 9.8% aqueous solution) were added to 1145 parts by weight of the dispersion prepared above, followed by a fluorinated surfactant (FC-120, 1.07 parts by weight of a 25% aqueous solution) to provide the coating fluid. To form the magenta imaging layer 40, this coating fluid was coated to a dried coating weight of 334 mg/ft$^2$.

The next layer of the imaging medium 30 is an interlayer 42, which is identical in composition, function and dried coating weight to the interlayer 38 described above.

Superposed on the interlayer 42 is a yellow imaging layer 44. To prepare the yellow imaging layer 44, 61.6 parts by weight of a leuco dye of formula:

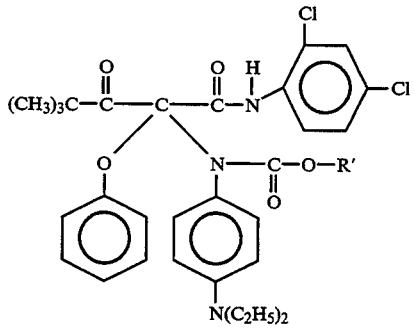

in which R′ is a tertiary butyl group (the compounds in which R′ is an isobutyl or benzyl group may alternatively be used), 1.54 parts by weight of an infra-red dye of formula:

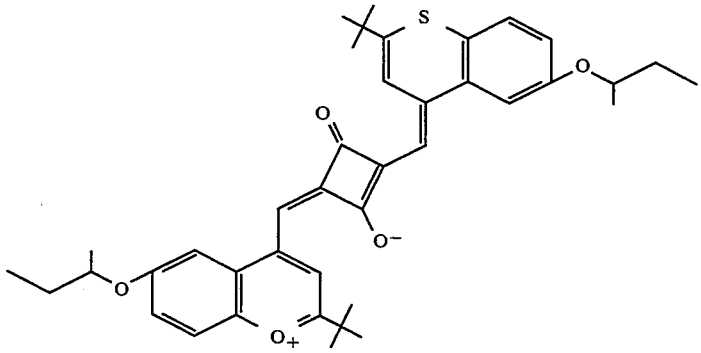

(prepared as described in the aforementioned application Ser. No. 08/065,350), 1.715 parts by weight of a hindered amine light stabilizer HALS-63, 15.435 parts by weight of a surfactant (Aerosol TR-70, with pH adjusted to 5.6 using a 1.0M aqueous solution of sodium hydroxide) and 46.2 parts by weight of a poly(ethyl methacrylate) binder (Elvacite 2043) were dissolved in 1235 parts by weight of dichloromethane. 1116 Parts by weight of deionized water were added to this solution, and the resulting mixture was homogenized. The dichloromethane was then removed by rotary evaporation under reduced pressure to leave a dispersion in water of particles whose size was in the 100–300 nm range. A water-soluble binder, poly(vinyl pyrrolidone) (PVP K-120, supplied by International Specialty Products, Wayne, N. J. 07470, 220.7 parts by weight of a 9.2% aqueous solution) was added to 875 parts by weight of the dispersion prepared above, followed by a fluorinated surfactant (FC-120, 1.14 parts by weight of a 25% aqueous solution) to provide the coating fluid. To form the yellow imaging layer 44, this coating fluid was coated to a dried coating weight of 415 mg/ft$^2$.

The next layer of the imaging medium 30 is an interlayer 46, which is identical in composition, function and dried coating weight to the interlayers 38 and 42 described above.

As already indicated, the layers 32–46 of the imaging medium 30 are produced by coating on to the transparent base 32. However, the remaining layers of the medium 30 are coated on to a disposable support 52 (described below) and then laminated to form the final imaging medium 30.

The disposable support 52 is conveniently 3 mil (76 μm) poly(ethylene terephthalate) film (Melinex 505, supplied by ICI Films, Hopewell, Va. 23860). On to this support 52 is coated a durable layer 50. To form this durable layer 50, 350 parts by weight of ethyl cellulose (Ethocel, 10 cps, Standard Grade, supplied by Dow Chemical, Midland, Mich. 48674) and a fluorinated surfactant (FC-43 1, supplied by the Minnesota Mining and Manufacturing Corporation, Minneapolis, Minn., 3.5 parts by weight of a 50% solution in ethyl acetate) were dissolved in a mixture of 2205 parts by weight of ethyl acetate and 945 parts by weight of toluene to provide the coating solution. To form the durable layer 50, this coating solution was coated to a dried coating weight of 988 mg/ft$^2$.

On to the durable layer 50 is coated an ultra-violet filter layer 48, which forms part of the topcoat 26 shown in FIG. 1 and serves to protect the imaging layers 44, 40 and 36 from the effects of ambient ultraviolet radiation. It has been found that the leuco dyes are susceptible to undergoing color changes when exposed to ultraviolet radiation during storage before or after imaging; such color changes are obviously undesirable since they increase the $D_{min}$ of the image and may distort the colors therein. To prepare the filter layer 48, 350 parts by weight of ethyl cellulose (Ethocel, 10 cps, Standard Grade), 35 parts by weight of Tinuvin 328 (an ultra-violet filter) and a fluorinated surfactant (FC-43 1, 3.5 parts by weight of a 50% solution in ethyl acetate) were dissolved in a mixture of 2205 parts by weight of ethyl acetate and 945 parts by weight of toluene to provide the coating solution. To form the filter layer 48, this coating solution was coated to a dried coating weight of 991 mg/ft$^2$.

In combination, the durable layer 50, the filter layer 48 and the interlayer 46 are sufficiently thick to serve as a bubble-suppressant layer to suppress the formation of bubbles in the imaging layers during imaging of the medium 30, as described in International Patent Application No. PCT/US92/02055 (Publication No. WO 92/19454), and serve as a protective layer for the fragile imaging layers in the final slide blank.

The structure comprising the disposable layer 52, the durable layer 50 and the filter layer 48 is laminated under heat (250° F., 121° C.) and pressure to the structure comprising the layers 32–46, and then the disposable layer 52 is peeled away to form the final imaging medium 30.

The medium 30 may be imaged by exposing it simultaneously to the beams from three infra-red lasers having wavelengths in the ranges of 780–815 nm, 840–870 nm and 900–930 nm. The 900–930 nm beam images the cyan imaging layer 36, the 840–870 nm beam images the magenta imaging layer 40 and the 780–815 nm beam images the yellow imaging layer 44. Thus, a multicolor image is formed in the imaging medium 30, and this multicolor image requires no further development steps. Furthermore, the medium 30 may be handled in normal room lighting before exposure, and the apparatus in which the imaging is performed need not be light-tight.

From the description given above, it will be seen that when the imaging medium shown in FIG. 3 is incorporated into a slide blank of the invention as shown in FIGS. 1 and 2 with the upper surface (in FIG. 3) of the durable layer 50 forming one external surface of the slide blank, all parts of the imaging layers 36, 40 and 44 lie less than 0.05 mm from this external surface (the total thickness of the layers 36–50 is approximately 44 μm, or 0.044 mm). Accordingly, when a slide produced from such a slide blank is projected, the close proximity of the imaged layers 36, 40 and 44 to the external surface of the slide facing the projector bulb allows for very efficient dissipation of the large amounts of heat which may be generated in the imaged layers 36, 40 and 44 by absorption of projector radiation, especially since the heat-generating imaged layers are disposed on the face of the slide facing the projector bulb, where the airflow across the slide is usually greater than on the opposed face of the slide. Furthermore, if additional protection of the imaging layers is deemed desirable, the thickness of the durable layer 52 can be increased, or multiple durable layers provided, without placing any part of the imaging layers 36, 40 and 44 more than about 0.10 mm from the external surface of the slide blank formed by the exposed face of the durable layer(s).

FIG. 4 shows a second imaging medium, generally designated 60, which can alternatively be used as the imageable layer 20 and the protective layer 26 in the slide blank shown in FIGS. 1 and 2. The imaging medium 60 is of the type described in the aforementioned U.S. Pat. No. 5,286,612 and comprises a support 62, which is identical to the support 32 shown in FIG. 3. On the support 62 is disposed an acid-generating layer 64 comprising a superacid precursor, an infra-red sensitizing dye and a secondary acid generator, which undergoes a superacid-catalyzed thermal decomposition to form a second acid. On the opposed side of the acid-generating layer 64 from the support 62 is disposed a color-forming layer 66 comprising an acid-sensitive material, which is colorless in the absence of acid, but turns yellow in the presence of acid, and a small amount of a base. The acid-generating layer 64 and the color-forming layer 66 both contain a binder having a glass transition temperature substantially above room temperature.

Superposed on the color-forming layer 66 is an acid-impermeable layer 68, which serves to prevent acid generated in the acid-generating layer 64 during imaging penetrating beyond the color-forming layer 66. Superposed on the acid-impermeable layer 68 are a second acid-generating layer 70 and a second color-forming layer 72, which are similar to the layers 64 and 66 respectively, except that the infra-red sensitizing dye in the layer 70 absorbs at a wavelength different from that of the infra-red sensitizing dye in the layer 64, and that the acid-sensitive material in the layer 72 turns cyan in the presence of acid. The remaining layers of the imaging medium 60 are a second acid-impermeable interlayer 74, identical to the layer 68, a third acid-generating layer 76 and a third color-forming layer 78

(which are similar to the layers 64 and 66 respectively, except that the infra-red sensitizing dye in the layer 76 absorbs at a wavelength different from that of the infra-red sensitizing dyes in the layers 64 and 70, and that the acid-sensitive material in the layer 78 turns magenta in the presence of acid), and an abrasion-resistant topcoat 80, which serves as the protective layer 26 when the imaging medium shown in FIG. 4 is incorporated into a slide blank as shown in FIGS. 1 and 2.

As described in the aforementioned U.S. Pat. No. 5,286,612, the imaging medium 60 is first exposed in a manner similar to the imaging medium 30 discussed above, by writing on selected areas of the medium with three infra-red lasers tuned to the wavelengths of the infra-red sensitizing dyes in the acid-generating layers 64, 70 and 76. Within the exposed regions of each acid-generating layer, the exposure to infra-red radiation causes breakdown of the superacid precursor, with formation of the corresponding superacid buffered by the sensitizing dye. After this infra-red exposure, the imaging medium 60 is passed beneath a mercury lamp and given a blanket ultraviolet exposure; this exposure may use three different ultra-violet wavelengths, with each acid-generating layer 64, 70 and 76 being sensitized to one of these three ultra-violet wavelengths, but in some cases it may be possible to use only a single ultra-violet wavelength for all three acid-generating layers. The ultra-violet exposure causes formation of unbuffered superacid in the infra-red exposed areas of each acid-generating layer. Finally, the imaging medium 60 is passed between heated rollers; the heat applied by these rollers causes the superacid present in the infra-red exposed regions of the acid-generating layers 64, 70 and 76 to cause catalytic breakdown of the secondary acid generator therein, thereby causing formation of a quantity of second acid substantially greater than the quantity of unbuffered superacid generated by the ultra-violet exposure. The heat and pressure applied by the heated rollers also raise the acid-generating layers 64, 70 and 76 and the color-forming layers 66, 72 and 78 above their glass transition temperatures, thereby causing the components present in each acid-generating layer to intermix with the components present in the associated color-forming layer, so that, in infra-red exposed regions, the second acid produced in the acid-generating layer effects the color change of the acid-sensitive material, thereby forming an image.

The second slide blank 90 of this invention shown in FIG. 5 differs from that shown in FIGS. 1 and 2 in that the imaging medium 30' or 60' is modified to eliminate the support 32 or 62 and to provide a carrier 92 in contact with the durable layer 50 or topcoat 80 but peelable therefrom. This modified imaging medium 30' or 60' is formed by coating its various layers on to the carrier 92, the layers of course being coated in the reverse order from that used to form the imaging medium 30 or 60, as described above. If necessary, as is well known to those skilled in the coating art, a release layer may be coated on to the carrier 92 to render this carrier readily peelable from the remaining layers of the imaging medium 30' or 60'. To compensate for the absence of the support 32 or 62, the thickness of the second polycarbonate sheet **12*b*** is increased to 20 mil (0.5 mm).

As shown in FIG. 5, the slide blank 90 is assembled in a manner similar to that of the slide blank 10 shown in FIG. 1, except that the imaging layers of the imaging medium are laminated directly to the second sheet **12*b*, and after this bonding has been completed, the carrier 92** is peeled away from the durable layer or topcoat to leave the finished slide blank.

The third slide blank 100 of this invention shown in FIG. 6 closely resembles that shown in FIG. 5 except that in the slide blank 100 the durable layer 50 or topcoat 80 is coated on a first carrier 102, while the imaging layers are coated on a second carrier 104 (conveniently, when the imaging medium 30 shown in FIG. 3 is used in this type of slide blank, the filter layer 48 is coated on the first carrier with the durable layer 50). As in the second slide blank shown in FIG. 5, the support 32 or 62 is eliminated (the imaging layers being coated directly on to the second carrier 104) and to compensate for the absence of the support 32 or 62, the thickness of the second polycarbonate sheet **12*b* is increased to 20 mil (0.5 mm). The slide blank 100 is assembled in a manner very similar to the slide blank 90, except that two laminations are required; the imaging layers 34–46 or 64–78 are first laminated to the second sheet 12*b*, the second carder 104 is peeled away from the resultant structure, then the durable layer 50 or topcoat 80 is laminated over the imaging layers and finally the first carrier 102 is peeled from the top coat to leave the finished slide blank 100**.

From the foregoing it will be seen that the slide blank of the present invention overcomes numerous disadvantages associated with the use of conventional slides. A single slide blank of this invention can be imaged individually; it is not necessary to expose a whole roll of slide film before processing and mounting the slides, and the delays inherent in processing and mounting steps are avoided, as are the physical difficulties involved in handling small, fragile unmounted slides. Since the imaged portion of a slide of the present invention is integral with the "mount," the imaged portion cannot slip relative to the mount and the image will always project in the intended manner. The present slide provides good protection to the image by including layers of plastic or similar material on both sides of the imaged layers, while providing substantial resistance to delamination of the slide, and allowing imaging of the imageable layer without difficulties which would result from attempting to effect such imaging through layers of substantial thickness subject to gauge variations and birefringence problems. The present slide blank can eliminate the substantial "step" on the external surfaces of conventional mounted slides, and the problems associated with the collection of dust, fibers and detritus in this step. The slide of the present invention can include a large legend area to carry permanent identifying indicia that cannot become detached from the slide, and can be printed at the same time as the slide is imaged, thus avoiding the problems involved in associating already-printed slides with appropriate indicia. Finally, as discussed above the present slide blank can allow for variation in the shape of the image projected, and can allow portrait and landscape images, and images with other aspect ratios and shapes, to be printed in the same orientation on the same slide blank.

We claim:

1. A slide blank comprising:

a support at least part of which is essentially transparent;

an imageable layer superposed on one face of the support, the imageable layer not being substantially sensitive to visible radiation but comprising a color-forming composition, which, upon imagewise exposure to actinic radiation, forms a colored material, thereby forming in the imageable layer an image which can be viewed in transmission; and a protective layer superposed on the imageable layer on the opposed side thereof from the support, at least part of the protective layer being essentially transparent;

the support, imageable layer and protective layer being secured together to form a slide blank having a thickness of at least about 0.8 mm, and the thickness of the protective layer being such that no part of the imageable layer containing the color-forming composition is more than about 0.2 mm from one external surface of the slide blank.

2. A slide blank according to claim 1 wherein the thickness of the protective layer is such that no part of the imageable layer containing the color-forming composition is more than about 0.15 mm from one external surface of the slide blank.

3. A slide blank according to claim 2 wherein the thickness of the protective layer is such that no part of the imageable layer containing the color-forming composition is more than about 0.10 mm from one external surface of the slide blank.

4. A slide blank according to claim 1 wherein the thickness of the protective layer is at least about 10 μm.

5. A slide blank according to claim 4 wherein the thickness of the protective layer is at least about 20 μm.

6. A slide blank according to claim 1 wherein the support, imageable layer and protective layer are of substantially the same dimensions in the plane of the imageable layer and are secured together so that the protective layer and the imageable layer extend across substantially the whole area of the support.

7. A slide blank according to claim 6 in the form of a flat lamina having two substantially planar major surfaces on opposed sides thereof.

8. A slide blank according to claim 7 in the form of a substantially square lamina having an edge length of from about 40 to about 70 mm and a thickness of from about 0.8 to about 1.7 mm.

9. A slide blank according to claim 8 having a thickness of at least about 1 mm and a protective layer of such thickness that no part of the imageable layer containing the color-forming composition is more than about 0.15 mm from one external surface of the slide blank.

10. A slide blank according to claim 1 wherein the color-forming composition comprises a radiation absorber capable of absorbing actinic radiation and a leuco dye which, upon absorption of radiation by the radiation absorber, forms the colored material.

11. A slide blank according to claim 10 wherein, upon absorption of the actinic radiation, the radiation absorber generates heat within the imageable layer, and the leuco dye undergoes a thermal reaction to form the colored material.

12. A slide blank according to claim 10 wherein the leuco dye comprises any one of:

a. an organic compound capable of undergoing, upon heating, an irreversible unimolecular fragmentation of at least one thermally unstable carbamate moiety, this organic compound initially absorbing radiation in the visible or the non-visible region of the electromagnetic spectrum, the unimolecular fragmentation visibly changing the appearance of the organic compound;

b. a substantially colorless di- or triarylmethane imaging compound possessing within its di- or triarylmethane structure an aryl group substituted in the ortho position to the meso carbon atom with a moiety ring-closed on the meso carbon atom to form a 5- or 6-membered ring, the moiety possessing a nitrogen atom bonded directly to the meso carbon atom and the nitrogen atom being bound to a group with a masked acyl substituent that undergoes fragmentation upon heating to liberate the acyl group for effecting intramolecular acylation of the nitrogen atom to form a new group in the ortho position that cannot bond to the meso carbon atom, whereby the di- or triarylmethane compound is rendered colored;

c. a colored di- or triarylmethane imaging compound possessing within its di- or triarylmethane structure an aryl group substituted in the ortho position to the meso carbon atom with a thermally unstable urea moiety, the urea moiety undergoing a unimolecular fragmentation reaction upon heating to provide a new group in the ortho position that bonds to the meso carbon atom to form a ring having 5 or 6 members, whereby the di- or triarylmethane compound becomes ring-closed and rendered colorless;

d. in combination, a substantially colorless di- or triarylmethane compound possessing on the meso carbon atom within its di- or triarylmethane structure an aryl group substituted in the ortho position with a nucleophilic moiety which is ring-closed on the meso carbon atom, and an electrophilic reagent which upon heating and contacting the di- or triarylmethane compound undergoes a bimolecular nucleophilic substitution reaction with the nucleophilic moiety to form a colored, ring-opened di- or triarylmethane compound;

e. a compound of the formula $$[M'(X)_q]_p-D$$

wherein M' has the formula:

$$Z'-\underset{\underset{R}{|}}{N}-$$

wherein R is alkyl; $-SO_2R^1$ wherein $R^1$ is alkyl; phenyl; naphthyl; or phenyl substituted with alkyl, alkoxy, halo, trifluoromethyl, cyano, nitro, carboxyl, $-CONR^2R^3$ wherein $R^2$ and $R^3$ each are hydrogen or alkyl, $-CO_2R^4$ wherein $R^4$ is alkyl or phenyl, $-COR^5$ wherein $R^5$ is amino, alkyl or phenyl, $-NR^6R^7$ wherein $R^6$ and $R^7$ each are hydrogen or alkyl, $-SO_2NR^8R^9$ wherein $R^8$ and $R^9$ each are hydrogen, alkyl or benzyl; Z' has the formula:

$$-\overset{\overset{O}{\|}}{C}-O-\underset{\underset{CH_3}{|}}{\overset{\overset{CH_3}{|}}{C}}-R'$$

wherein R' is halomethyl or alkyl; X is —N=, $-SO_2-$ or $-CH_2-$; D taken with X and M' represents the radical of a color-shifted organic dye; q is 0 or 1; and p is a whole number of at least 1; Z' being removed from M' upon the application of heat to effect a visually discernible change in spectral absorption characteristics of the dye;

f. a substantially colorless di- or triarylmethane compound of the formula:

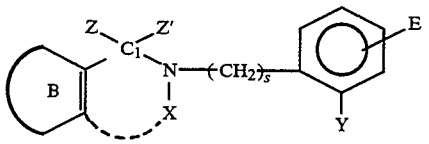

wherein ring B represents a carbocyclic aryl ring or a heterocyclic aryl ring; $C_1$ represents the meso carbon atom of the di- or triarylmethane compound; X represents —C(=O)—; —$SO_2$— or —$CH_2$— and completes a moiety ring-closed on the meso carbon atom, the moiety including the nitrogen atom bonded directly to the meso carbon atom; Y represents —NH—C(=O)—L, wherein L is a leaving group that departs upon thermal fragmentation to unmask —N=C=O for effecting intramolecular acylation of the nitrogen atom to open the N-containing ring and form a new group in the ortho position of ring B that cannot bond to the meso carbon atom; E is hydrogen, an electron-donating group, an electron-withdrawing group or a group, either an electron-donating group or an electron-neutral group that undergoes fragmentation upon heating to liberate an electron-withdrawing group; s is 0 or 1; and Z and Z' taken individually represent the moieties to complete the auxochromic system of a diarylmethane or triarylmethane dye when the N-containing ring is open, and Z and Z' taken together represent the bridged moieties to complete the auxochromic system of a bridged triarylmethane dye when the N-containing ring is open;

g. a colorless precursor of a preformed image dye substituted with (a) at least one thermally removable protecting group that undergoes fragmentation from the precursor upon heating and (b) at least one leaving group that is irreversibly eliminated from the precursor upon heating, provided that neither the protecting group nor the leaving group is hydrogen, the protecting and leaving groups maintaining the precursor in its colorless form until heat is applied to effect removal of the protecting and leaving groups whereby the colorless precursor is converted to an image dye;

h. mixed carbonate ester of a quinophthalone dye and a tertiary alkanol containing not more than about 9 carbon atoms;

i. a leuco dye represented by:

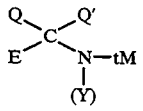

wherein:

E represents a thermally removable leaving group;

tM represents a thermally migratable acyl group;

Q, Q' and C taken together represent a dye-forming coupler moiety wherein C is the coupling carbon of the coupler moiety;

and, (Y) taken together with N represents an aromatic amino color developer, one of Q, Q' and (Y) containing an atom selected from the atoms comprising Group 5A/Group 6A of the Periodic Table, the groups E and tM maintaining the leuco dye in a substantially colorless form until the application of heat causes the group E to be eliminated from the leuco dye and the group tM to migrate from the N atom to the Group 5A/Group 6A atom thereby forming a dye represented by:

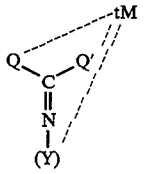

wherein the dotted lines indicate that the tM group is bonded to the Group 5A/Group 6A atom in one of Q, Q' and (Y).

13. A slide blank according to claim 10 wherein, upon absorption of the actinic radiation, the radiation absorber generates acid within the imageable layer, and, upon exposure to this acid, the leuco dye forms the colored material.

14. A slide blank according to claim 13 wherein the color-forming composition further comprises a superacid precursor capable of being decomposed, by radiation of a wavelength shorter than that of the actinic radiation absorbed by the radiation absorber, to form a superacid, the superacid precursor, in the absence of the radiation absorber, not being decomposed by the actinic radiation absorbed by the radiation absorber but, in the presence of the radiation absorber and the actinic radiation absorbed by the radiation absorber, decomposing to form a protonated product derived from the radiation absorber, the color-forming composition further comprising a secondary acid generator capable of being thermally decomposed to form a second acid, the thermal decomposition of the secondary acid generator being catalyzed in the presence of the superacid derived from the superacid precursor.

15. A slide blank according to claim 10 having a plurality of imageable layers, each of the imageable layers being capable of generating a different color, each of the imageable layers having a radiation absorber capable of absorbing actinic radiation of a wavelength different from that of the radiation absorbed by the radiation absorber present in each of the other imageable layers.

16. A slide blank according to claim 1 further comprising a mask layer having a substantially transparent central portion and a non-transparent peripheral portion surrounding the central portion, the support, imageable layer and protective layer extending across essentially the entire transparent central portion of the mask layer with the transparent portions of the support and the protective layer being disposed adjacent the transparent central portion of the mask layer.

17. A slide blank according to claim 16 wherein the mask layer is disposed on the opposed side of the support from the imageable layer.

18. A slide blank according to claim 17 wherein the two major surfaces of the mask layer differ in color.

19. A slide comprising:

a support at least part of which is essentially transparent;

an image layer superposed on one face of the support and comprising an imagewise distribution of a colored material forming an image which can be viewed in transmission; and a protective layer superposed on the image layer on the opposed side thereof from the support, at least part of the protective layer being essentially transparent;

the support, image layer and protective layer being secured together to form a slide having a thickness of at least about 0.8 mm, and the thickness of the protective layer being such that no part of the image layer containing the colored material which forms the image is more than about 0.2 mm from one external surface of the slide.

20. A slide according to claim 19 wherein the thickness of the protective layer is such that no part of the image layer containing the colored material which forms the image is more than about 0.15 mm from one external surface of the slide.

21. A slide according to claim 20 wherein the thickness of the protective layer is such that no part of the image layer containing the colored material which forms the image is more than about 0.10 mm from one external surface of the slide.

22. A slide according to claim 19 wherein the thickness of the protective layer is at least about 10 μm.

23. A slide according to claim 22 wherein the thickness of the protective layer is at least about 20 μm.

24. A slide according to claim 19 wherein the support, image layer and protective layer are of substantially the same dimensions in the plane of the image layer and are secured together so that the image layer and protective layer extend across substantially the whole area of the support.

25. A slide according to claim 24 in the form of a flat lamina having two substantially planar major surfaces on opposed sides thereof.

26. A slide according to claim 25 in the form of a substantially square lamina having an edge length of from about 40 to about 70 mm and a thickness of from about 0.8 to about 1.7 mm.

27. A slide according to claim 26 having a thickness of at least about 1 mm and wherein the thickness of the protective layer is such that no part of the image layer containing the colored material which forms the image is more than about 0.15 mm from one external surface of the slide.

28. A slide according to claim 19 wherein the image layer comprises a radiation absorber capable of absorbing infra-red radiation having a wavelength in the range of about 700 to about 1200 nm.

29. A slide according to claim 19 further comprising a mask layer having a substantially transparent central portion and a non-transparent peripheral portion surrounding the central portion, the support, image layer and protective layer extending across essentially the entire transparent central portion of the mask layer with the transparent portions of the support and the protective layer being disposed adjacent the transparent central portion of the mask layer.

30. A slide according to claim 29 wherein the mask layer is disposed on the opposed side of the support from the imageable layer.

31. A slide according to claim 29 wherein the two major surfaces of the mask layer differ in color.

32. A slide according to claim 29 wherein the image has a legend portion lying adjacent the peripheral, non-transparent portion of the mask layer so that the legend portion of the image can be viewed in reflection against the mask layer.

33. A process for producing a slide, the process comprising:

providing a slide blank comprising a support at least part of which is essentially transparent; an imageable layer superposed on one face of the support, the imageable layer not being substantially sensitive to visible radiation but comprising a color-forming composition, which, upon imagewise exposure to actinic radiation, forms a colored material, thereby forming in the imageable layer an image which can be viewed in transmission; and a protective layer superposed on the imageable layer on the opposed side thereof from the support, at least part of the protective layer being essentially transparent; the support, imageable layer and protective layer being secured together to form a slide blank having a thickness of at least about 0.8 mm, and the thickness of the protective layer being such that no part of the imageable layer containing the color-forming composition is more than about 0.2 mm from one external surface of the slide blank; and exposing the slide blank to actinic radiation, and thus forming in the imageable layer an image which can be viewed in transmission, thereby producing a slide.

34. A process according to claim 33 wherein the color-forming composition comprises a radiation absorber capable of absorbing actinic radiation and a leuco dye which, upon absorption of radiation by the radiation absorber, forms the colored material.

35. A process according to claim 34 wherein the slide blank comprises a plurality of color-forming layers, each of these color-forming layers comprising a color-forming composition which, upon exposure to actinic radiation, forms a colored material, each of the color-forming compositions comprising a radiation absorber capable of absorbing actinic radiation, and a leuco dye which, upon absorption of radiation by the radiation absorber, forms the colored material, the leuco dyes in the plurality of color-forming layers forming colored materials having differing colors, and the radiation absorbers in the plurality of color-forming layers absorbing at differing wavelengths, and wherein the formation of the image is effected by exposing the slide blank to actinic radiation having a plurality of wavelengths, thereby forming color in each of the color-forming layers.

36. A process according to claim 33 wherein the slide blank further comprises a mask layer having a substantially transparent central portion and a non-transparent peripheral portion surrounding the central portion, the support, imageable layer and protective layer extending across essentially the entire transparent central portion of the mask layer with the transparent portions of the support and the protective layer being disposed adjacent the transparent central portion of the mask layer.

37. A process according to claim 36 wherein the color-forming layer is disposed between the protective layer and the mask layer and wherein the actinic radiation used to form the image is passed through the protective layer.

38. A process according to claim 36 wherein at least one part of the image formed extends beyond the portion of the imageable layer adjacent the transparent central portion of the mask layer.

39. A process according to claim 38 wherein the image comprises a legend portion lying adjacent the peripheral, non-transparent portion of the mask layer so that the legend portion of the image can be viewed in reflection against the mask layer, the legend portion comprising at least one identifying indicium relating to the portion of the image which can be viewed in transmission through the transparent central portion of the mask layer.

40. A process according to claim 36 wherein at least one portion of the imageable layer adjacent the periphery of the transparent central portion of the mask layer is rendered substantially opaque during formation of the image, so that the image as seen in transmission differs in at least one of size, shape and aspect ratio from the transparent central portion of the mask layer.

41. A process according to claim 33 wherein the slide blank is deformed so that the imageable layer has substantially the form of part of the surface of a cylinder during the exposure to the actinic radiation.

* * * * *